US007434800B2

(12) United States Patent
Asada et al.

(10) Patent No.: US 7,434,800 B2
(45) Date of Patent: Oct. 14, 2008

(54) SHEET SEPARATION MEMBER AND SHEET SUPPLY DEVICE

(75) Inventors: Tetsuo Asada, Kuwana (JP); Yukio Shiohara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 277 days.

(21) Appl. No.: 11/070,258

(22) Filed: Mar. 3, 2005

(65) Prior Publication Data

US 2005/0194734 A1 Sep. 8, 2005

(30) Foreign Application Priority Data

Mar. 5, 2004 (JP) ..... 2004-063161
Sep. 30, 2004 (JP) ..... 2004-289140

(51) Int. Cl.
*B65H 3/52* (2006.01)

(52) U.S. Cl. ..... 271/121; 271/167

(58) Field of Classification Search ..... 271/121, 271/167

See application file for complete search history.

(56) References Cited

U.S. PATENT DOCUMENTS

| | | | | |
|---|---|---|---|---|
| 6,139,007 | A | 10/2000 | Cahill et al. | |
| 6,824,131 | B2 | 11/2004 | Togashi | |
| 7,000,916 | B2 * | 2/2006 | Asada et al. | 271/121 |
| 7,011,303 | B2 * | 3/2006 | Takito et al. | 271/121 |
| 7,014,186 | B2 | 3/2006 | Shiohara et al. | |
| 7,066,461 | B2 * | 6/2006 | Asada | 271/121 |
| 7,108,257 | B2 * | 9/2006 | Shiohara et al. | 271/104 |
| 2004/0032077 | A1 * | 2/2004 | Oh et al. | 271/121 |
| 2004/0084831 | A1 | 5/2004 | Asada | |

FOREIGN PATENT DOCUMENTS

| | | |
|---|---|---|
| EP | 1350746 | 8/2003 |
| EP | 1 350 746 A2 | 10/2003 |
| EP | 1 389 599 | 2/2004 |
| EP | 1 350 746 A3 | 11/2004 |
| JP | 06255821 | 9/1994 |
| JP | 7251955 | 10/1995 |
| JP | 2002-137838 A | 5/2002 |
| JP | 2002137838 | 5/2002 |
| JP | 2003-026348 A | 1/2003 |
| JP | 2003-285948 A | 10/2003 |

OTHER PUBLICATIONS

European Search Report; Application No. 05251295.1-2314; Dated Jun. 15, 2005; Total pp. (4).

* cited by examiner

*Primary Examiner*—Kaitlin S Joerger
(74) *Attorney, Agent, or Firm*—Banner & Witcoff, Ltd

(57) ABSTRACT

A sheet separation member for use in a sheet supply device including a sheet feed roller that feeds stacked sheets. The sheet separation member includes a body portion including a plurality of protrusion portions that engages with leading edges of the stacked sheets in a sheet feeding direction, and a plurality of arm portions that supports the protrusion portions in positions where the protrusion portions are engaged with the leading edges of the sheets, and a plurality of plate spring portions integrally formed with the body portion to support the body portion in a predetermined region of the sheet supply device.

24 Claims, 16 Drawing Sheets

SHEET SEPARATION MEMBER AND SHEET SUPPLY DEVICE

BACKGROUND OF THE INVENTION

1. Field of the Invention

The present invention relates to a sheet separation member cooperating with a sheet feed roller to separate and feed sheets of paper one by one in an image forming apparatus such as a printer, a copying machine or a facsimile, and a sheet supply device including the sheet separation member.

2. Description of the Related Art

As this type of device, for example, as shown in FIGS. 17A and 17B, there is heretofore known a device configured to have a sheet separation portion 92 disposed to come into contact with lower end surfaces of sheets of paper 90 so that only an uppermost one of the sheets of paper 90 is separated by a frictional force between the sheet separation portion 92 and the lower end surfaces of the sheets of paper 90 (e.g. see JP-A-2002-137838).

In the conventional device, a separation portion supporting portion 93 is formed to support the sheet separation portion 92 by means of two support portions 93*a* and 93*b* each having a protrusive upper section in a longitudinal direction. Incidentally, a gap 93*c* is formed between the sheet separation portion 92 and the separation portion supporting portion 93 so as to give flexibility to the sheet separation portion 92.

The sheet separation portion 92 is made of a rubber material such as polyurethane. The sheet separation portion 92 has a convex end surface substantially fit to the shape of an end surface of a holder portion 91 disposed on the upper portion of the sheet separation portion 92. As shown in FIGS. 18A-18C, a protrusive portion 92*a* is formed in the sheet separation portion 92. The protrusive portion 92*a* is configured to always protrude from a long hole of the holder 91 made of metal. The long hole is formed so as to extend in a sheet stacking direction.

The height of the protrusive portion 92*a* is set so that the protrusive portion 92*a* protrudes from the long hole of the holder portion 91 by a predetermined amount. The lower edges of the sheets of paper 90 stored in a sheet storage portion are brought into contact with the upper surface of the protrusive portion 92*a*.

Fine irregularities 92*b* are formed in the upper surface of the protrusive portion 92*a*. The fine irregularities 92*b* act to increase the frictional force generated between the sheet separation portion 92 and the lower edges of the sheets of paper 90.

The conventional device is configured in this manner so that the sheets of paper 90 are separated one by one by the frictional force of the rubber material and the action of the fine irregularities 92*b* to increase the frictional force and in accordance with the balance with a sheet feed force of the sheet feed roller.

SUMMARY OF THE INVENTION

The aforementioned sheet supply device has a structure in which a load from the sheets of paper is received by the whole of the protrusive portion of the sheet separation portion. For this reason, the load applied to the protrusive portion varies largely according to the number of sheets of paper giving a load to the sheet separation portion. There is therefore a problem that setting of the flexibility of the sheet separation portion and design and manufacturing of the shape of each of the fine irregularities formed in the protrusive portion become complicated.

The protrusion amount of the protrusive portion 92*a* of the sheet separation portion 92 from the holder portion 91 is set in accordance with an elastic force of the sheet separation portion 92 made of a rubber material. Accordingly, there is another problem that the protrusion amount changes momentarily in accordance with a temperature condition, a humidity condition, and so on, so as to be very unstable.

Further, because the conventional sheet supply device is constituted by three members of the holder portion 91, the sheet separation member 92 and the separation portion supporting portion 93, the number of parts is large to thereby result in high cost.

In consideration of such circumstances, one of objects of the invention is to provide a sheet separation member which does not require complicated design and manufacturing and is small in the number of parts, and which can prevent multiple sheet feed (i.e. which can prevent sheets of paper from being fed collectively) so that the sheets of paper can be fed one by one surely, and a sheet supply device including the sheet separation member.

According to a first aspect of the invention, there is provided a sheet separation member for use in a sheet supply device including a sheet feed roller that feeds stacked sheets, the sheet separation member including: a body portion including a plurality of protrusion portions that engages with leading edges of the stacked sheets in a sheet feeding direction, and a plurality of arm portions that support the protrusion portions in positions where the protrusion portions are engaged with the leading edges of the sheets; and a plurality of plate spring portions integrally formed with the body portion to support the body portion in a predetermined region of the sheet supply device.

According to a second aspect of the invention, there is provided a sheet supply device including: a sheet storage portion that stores sheets; a sheet feed roller that feeds the sheets stored in the sheet storage portion to a predetermined conveyance path; an inclined surface located in the predetermined conveyance path so as to be inclined at an obtuse angle with respect to the sheets stored in the sheet storage portion, the inclined surface including a long hole being formed thereon so as to extend in a sheet conveyance direction; and a sheet separation member including: a body portion including a plurality of protrusion portions that engages with leading edges of the stacked sheets in a sheet feeding direction, and a plurality of arm portions that support the protrusion portions in positions where the protrusion portions are engaged with the leading edges of the sheets; and a plurality of plate spring portions integrally formed with the body portion to support the body portion in a predetermined region of the sheet supply device, wherein the sheet separation member is mounted in the sheet supply device so that the protrusion portions protrudes from the inclined surface through the long hole.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

An embodiment of the invention will be described below with reference to the drawings.

Incidentally, the embodiment shows the case where the invention is applied to a sheet supply device of a printer constituting a so-called multifunction machine.

Figure 1:
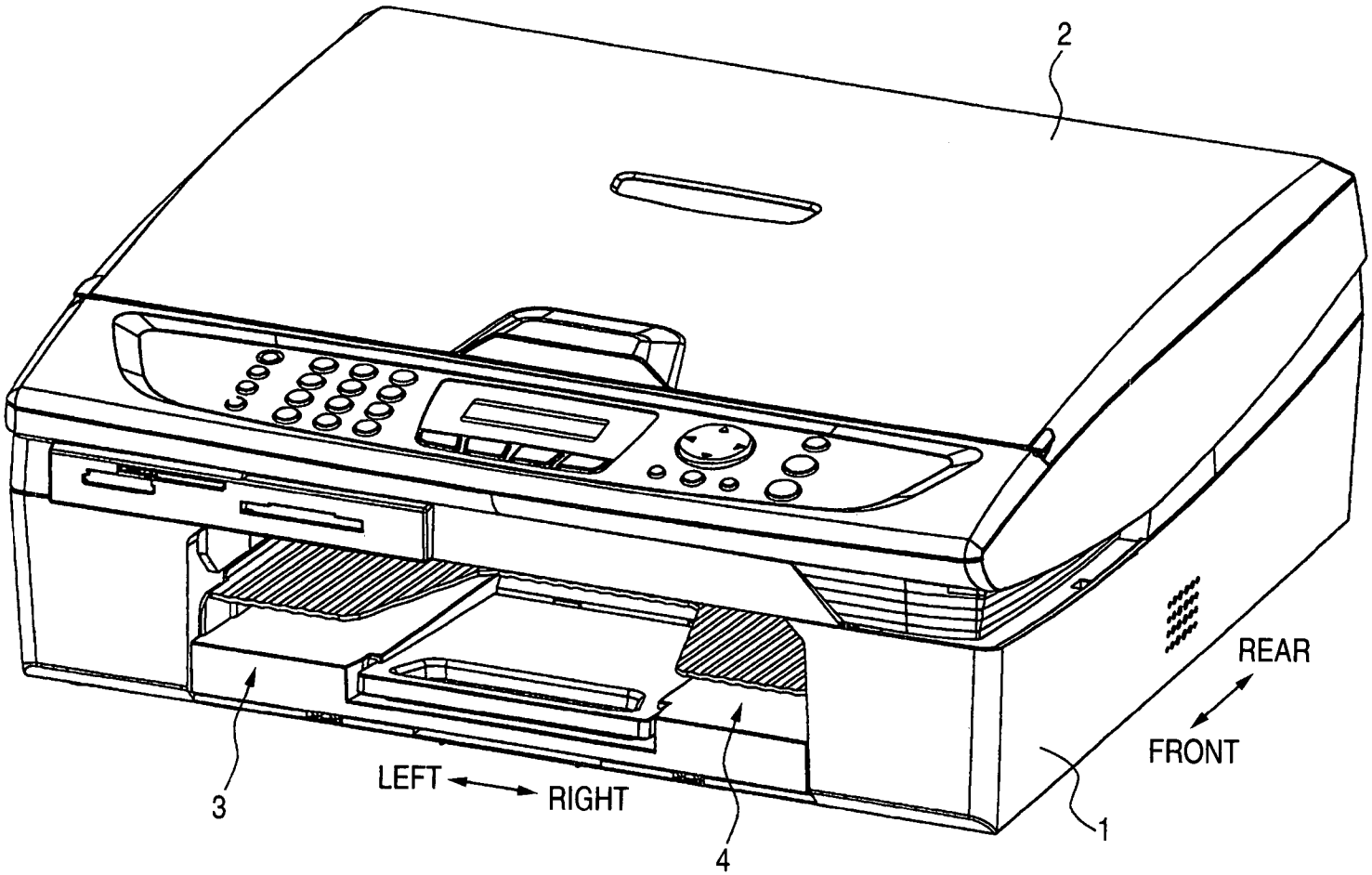
FIG. 1 is a perspective view showing an external appearance of a printer including a sheet supply device according to an embodiment.
Figure 2:
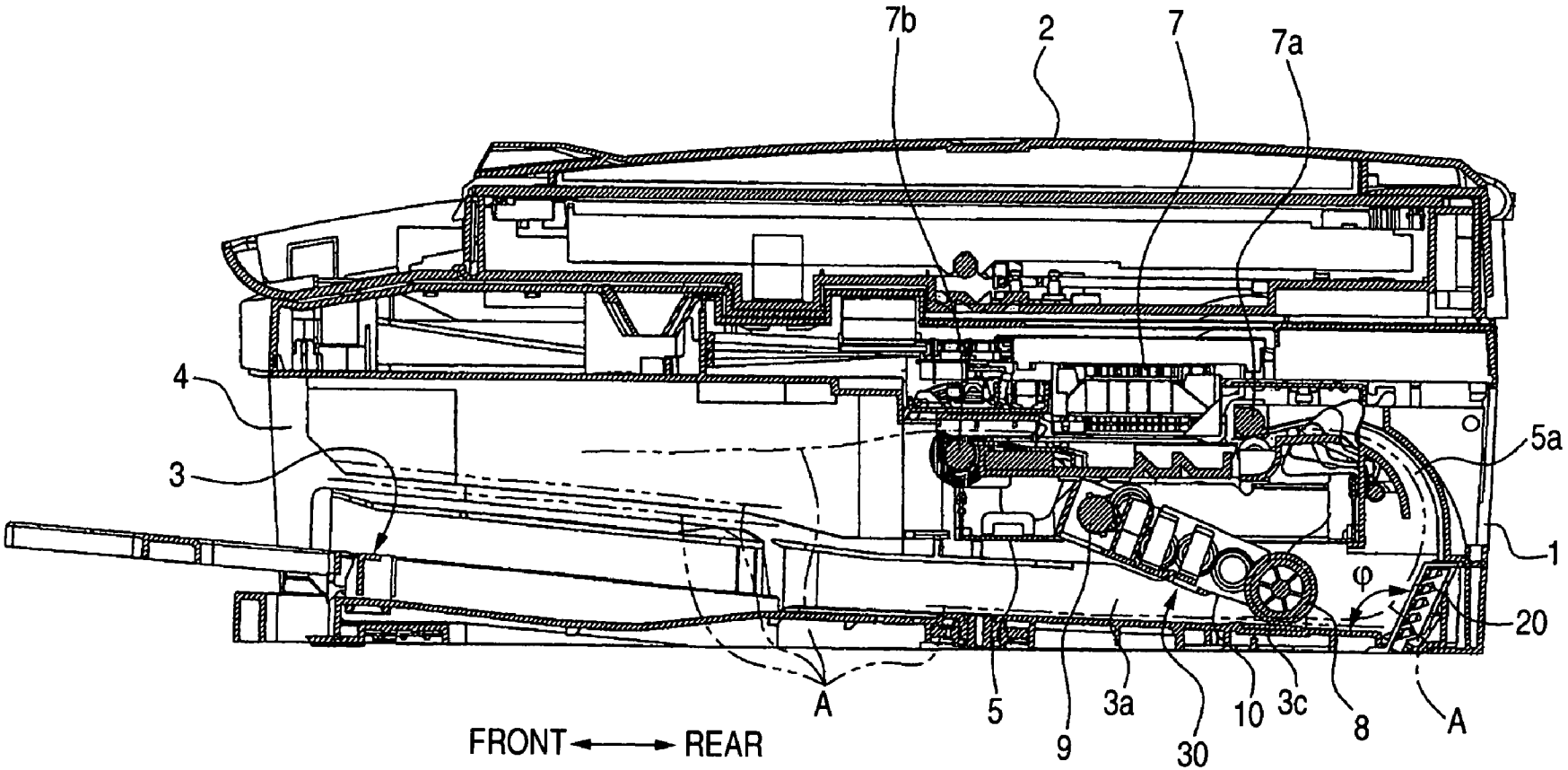
FIG. 2 is a sectional view of the printer depicted in FIG.

As shown in FIGS. 1 and 2, in the multifunction machine where a scanner 2 is provided on an upper portion of a casing 1, the printer according to the embodiment is provided for forming an image on a sheet A. The printer includes a sheet supply device 30 in a lower portion in the casing 1.

A metal frame 5 shaped like a box is disposed in the rear in the casing 1 and above the sheet supply device 30. The frame 5 is substantially shaped like a rectangular parallelepiped long in a left-right direction. The frame 5 is fixed while extending in the casing 1.

A recording portion 7 is disposed in an upper portion of the inside of the frame 5. A conveyance path 5*a* for leading a sheet A to the recording portion 7 from the rear of the sheet supply device 30 is formed in the rear of the frame 5. Specifically, the recording portion 7 is an inkjet type recording device. The recording portion 7 has introduction rollers 7*a* located in a place adjacent to an exit of the conveyance path 5*a*, and ejection rollers 7*b* located in a place where the sheet A having an image recorded thereon is ejected. Because the inkjet type recording device configured thus is known, description thereof will be omitted here.

An ejection portion for ejecting the sheet A from the recording portion 7 is provided in front of the frame 5 in the casing 1. The sheet A ejected to the ejection portion is stacked on a tray 3*b* of a sheet supply cassette 3 in the sheet supply device 30.

Figure 3:
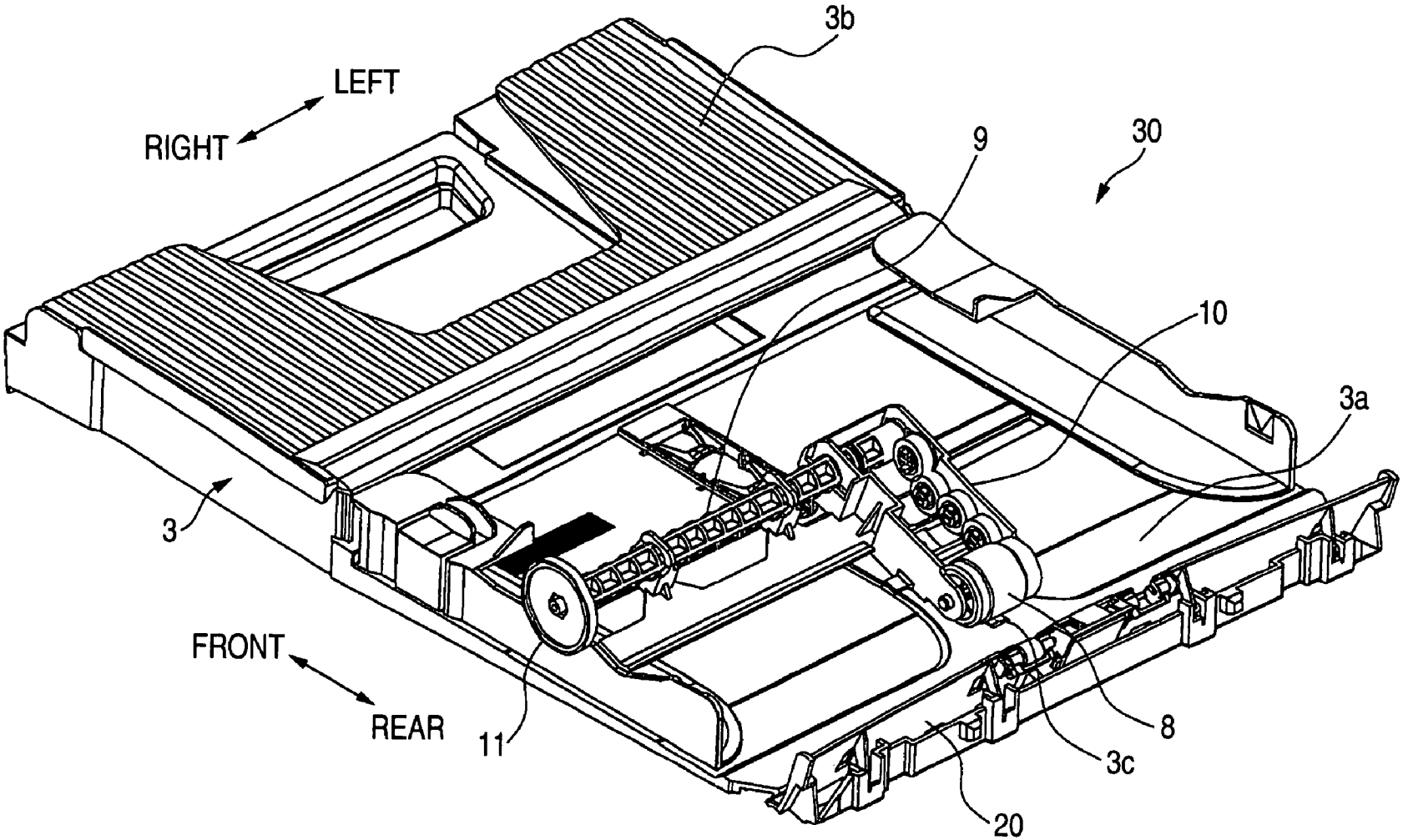
FIG. 3 is a perspective view of the sheet supply device mounted in the printer depicted FIG. 1.

FIG. 3 is a perspective view of the sheet supply device according to the embodiment.

The sheet supply device 30 exhibits an external appearance as shown in FIG. 3. The sheet supply cassette 3 in the sheet supply device 30 is inserted in the casing 1 so that the sheet supply cassette 3 can be pulled in and out freely in a front-rear direction through an opening portion 4. A sheet storage portion 3*a* for storing stacked sheets of paper A is provided in the sheet supply cassette 3. When the sheet supply cassette 3 is inserted into the casing 1, the sheet A in the sheet storage portion 3*a* is disposed in the rear in the casing 1. The tray 3*b* for accepting a sheet A having an image recorded thereon, as will be described later, is formed in front of the sheet supply cassette 3.

The sheet supply device 30 includes a pendulum type sheet feed roller 8 for feeding a sheet A in the sheet storage portion 3*a* to the recording portion 7. The sheet feed roller 8 is rotatably held in an end portion of an arm 10 which is a long support member pivoted by a driving shaft 9. Motive power is transmitted from the driving shaft 9 to the sheet feed roller 8 through gears serving as transmission rotators to thereby rotate the sheet feed roller 8.

The driving shaft 9 is pivoted in the frame 5 so as to extend in the left-right direction. A driving gear 11 is fixed to an end of the driving shaft 9. An output shaft of a driving source (not shown) such as a motor is dynamically connected to the driving gear 11. As a result, when the driving source is activated to rotate the driving shaft 9, the rotation of the driving shaft 9 is transmitted to the sheet feed roller 8 through the gears serving as transmission rotators. The sheet feed roller 8 comes into contact with the uppermost sheet of paper A in the sheet storage portion 3*a* to thereby feed the sheet A to the recording portion 7.

An inclined surface 20 is formed in the sheet supply device 30 according to the embodiment so as to be inclined at an obtuse angle $\phi$ with respect to the sheet A stored in the sheet storage portion 3*a* (see FIG. 2). The sheet A fed by the sheet feed roller 8 is conveyed to the conveyance path 5*a* while its leading edge is brought into contact with the inclined surface 20.

Figure 4:
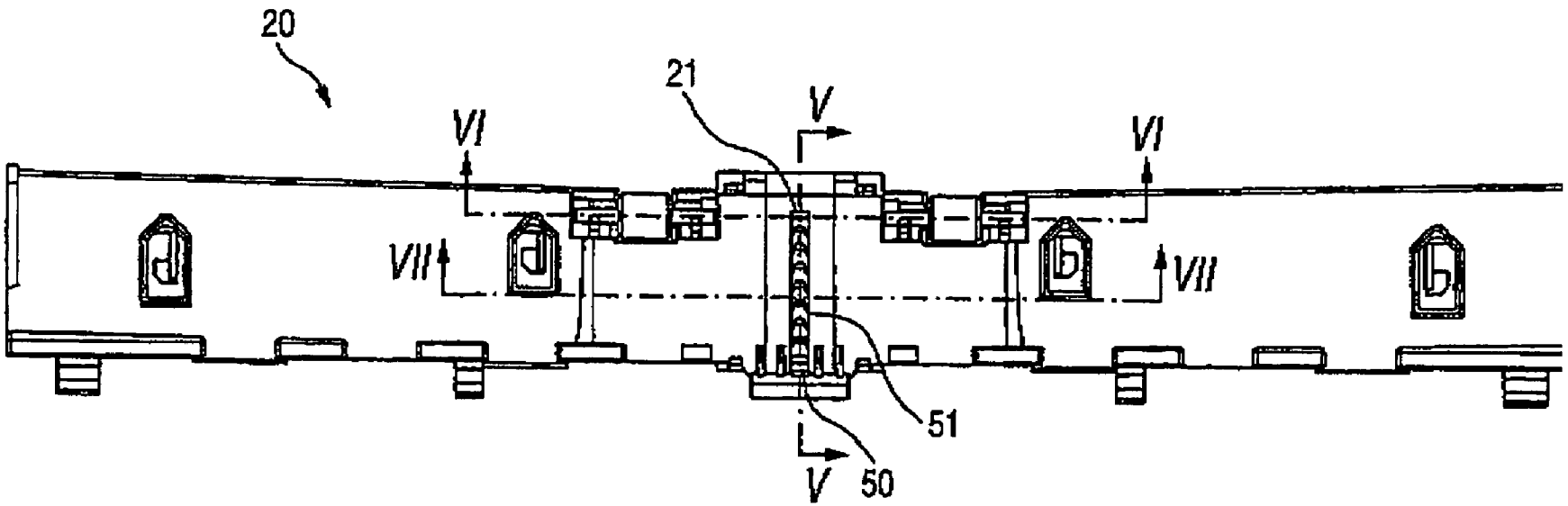
FIG. 4 is a front view showing the configuration of an inclined surface of the sheet supply device depicted in FIG. 3.
Figure 5:
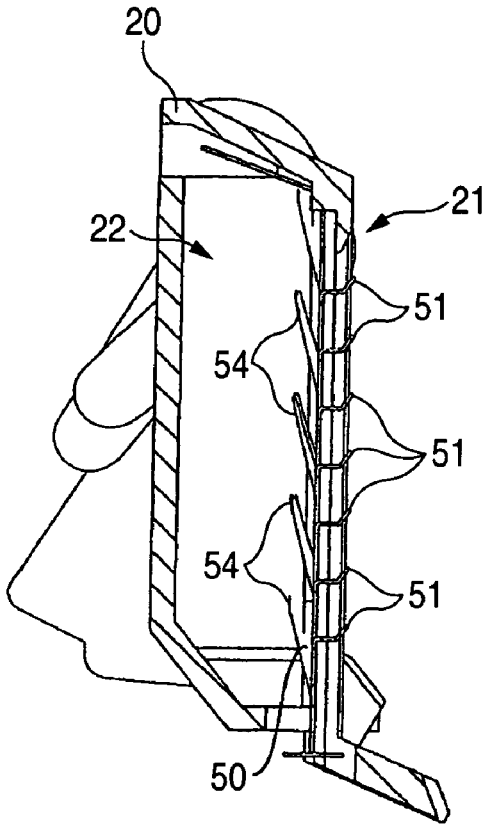
FIG. 5 is a sectional view taken on a line V-V, of the inclined surface depicted in FIG. 4.
Figure 6:
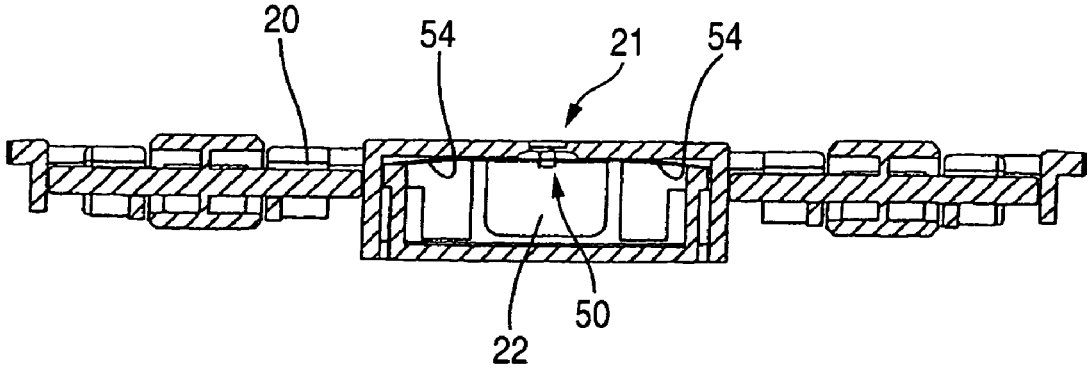
FIG. 6 is a sectional view taken on a line VI-VI, of the inclined surface depicted in FIG. 4.
Figure 7:
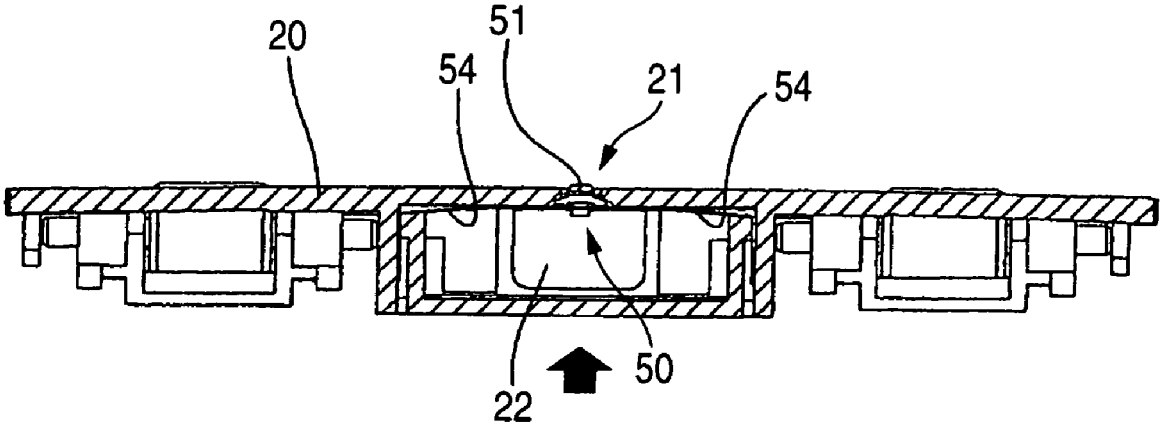
FIG. 7 is a sectional view taken on a line VII-VII, of the inclined surface depicted in FIG. 4.

FIG. 4 is a front view of the inclined surface 20 of the sheet supply device 30. FIG. 5 is a sectional view taken along the line V-V, of the inclined surface 20 shown in FIG. 4. FIG. 6 is a sectional view taken along the line VI-VI, of the inclined surface 20 shown in FIG. 4. FIG. 7 is a sectional view taken along the line VII-VII, of the inclined surface 20 shown in FIG. 4.

Figure 8A:
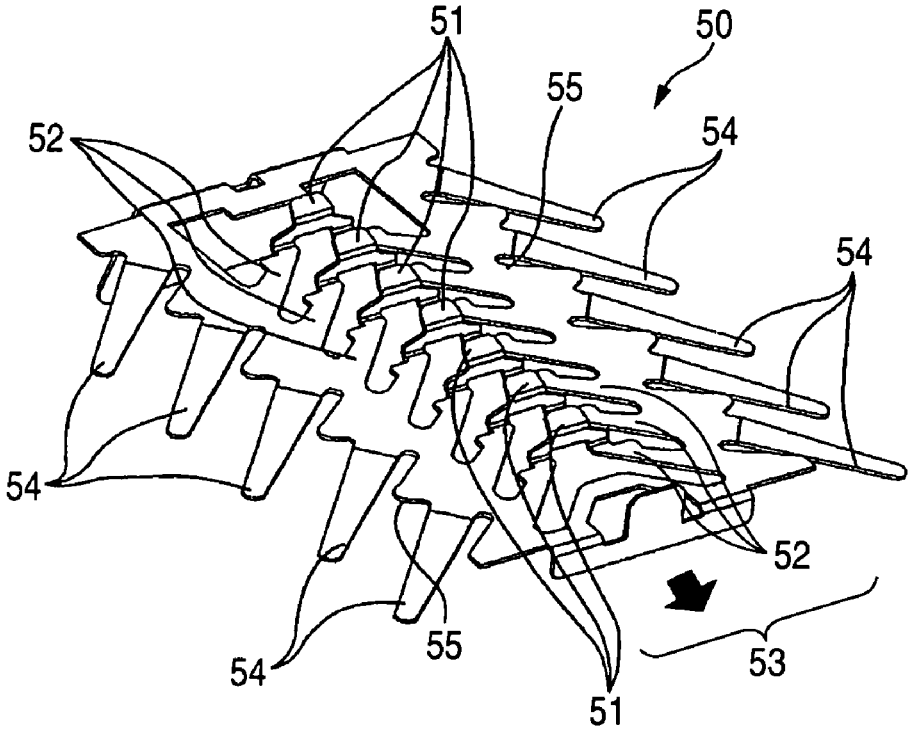
FIGS. 8A and 8B are perspective views showing a basic configuration of a sheet separation member according to the embodiment.
Figure 8B:
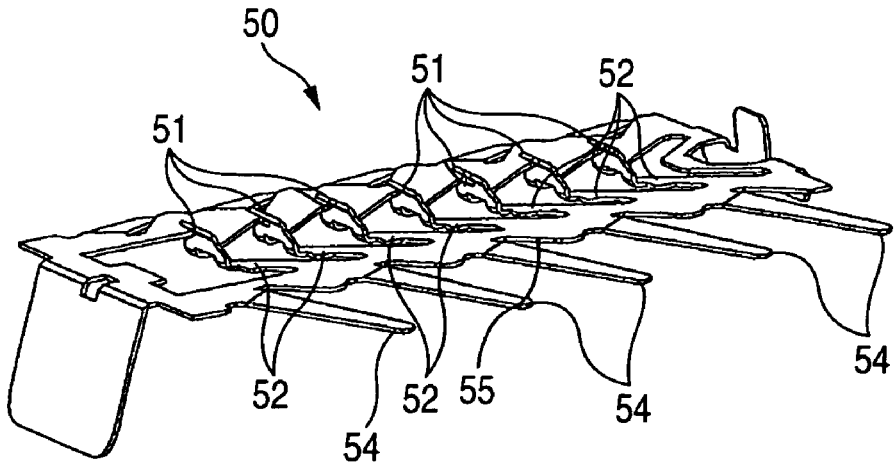
Figure 9A:
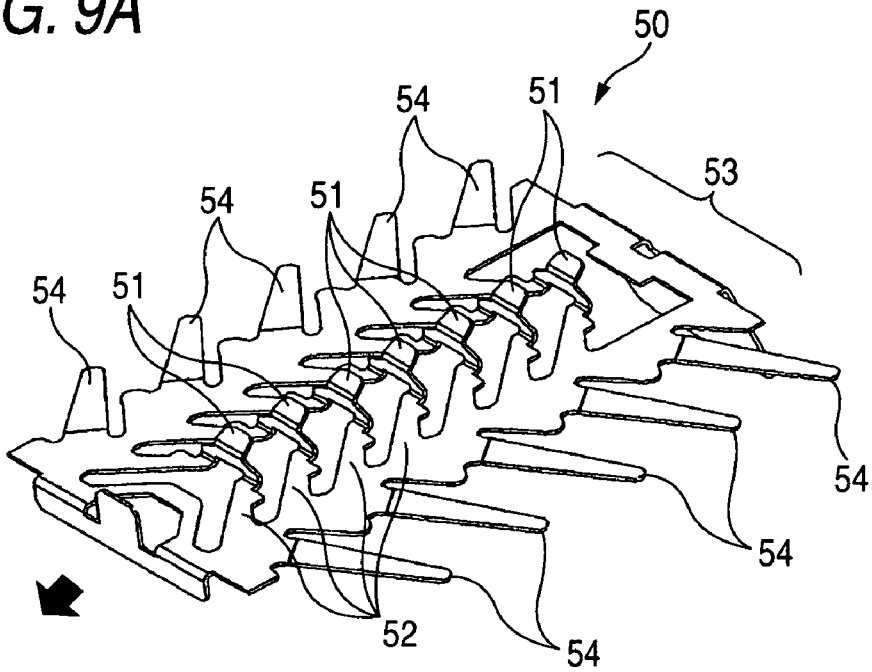
FIGS. 9A and 9B are perspective views showing another basic configuration of a sheet separation member according to the embodiment.
Figure 9B:
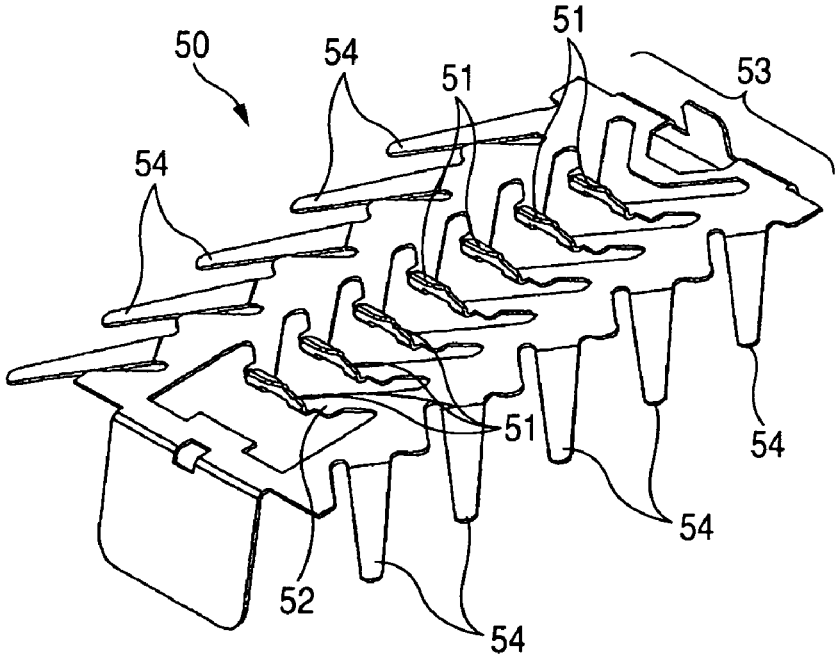

FIGS. 8A and 8B are perspective views of a sheet separation member 50 according to the invention. FIGS. 9A and 9B are perspective views of another example of the sheet separation member 50 according to the invention (the sheet separation member shown in FIGS. 8A and 8B and the sheet separation member shown in FIGS. 9A and 9B are different from each other in directions of plate spring portions 54).

First, the sheet separation member 50 according to the invention will be described.

As is apparent from FIGS. 8A and 8B or FIGS. 9A and 9B, the sheet separation member 50 includes a body portion 53, and plate spring portions 54. The body portion 53 has a plurality of protrusion portions 51, and a plurality of arm portions 52. The protrusion portions 51 engage with leading edges of stacked sheets of paper in the sheet feeding direction. The arm portions 52 support the protrusion portions 51 in positions where the protrusion portions 51 can be engaged with the leading edges of the sheets of paper. The plate spring portions 54 are formed so as to be integrated with the body portion 53. The plate spring portions 54 are provided for supporting the body portion 53 in a predetermined region of the sheet supply device 30.

When the protrusion portions 51 are engaged with the leading edges (in the sheet feeding direction) of the sheets of paper to be conveyed to the conveyance path by the sheet feed roller so that the leading edges of the sheets are caught by the protrusion portions, the stacked sheets come apart from one another. Finally, the protrusion portions 51 perform a function of separating a sheet of paper to be conveyed to the recording portion. Accordingly, the shape of each of the protrusion portions 51 is not limited particularly as long as the shape allows this function to be performed. The size of each of the protrusion portions 51 is also not limited particularly but may be decided suitably.

Although seven protrusion portions 51 are formed in the sheet separation member 50 according to the invention as shown in FIGS. 8A and 8B or FIGS. 9A and 9B, the number of protrusion portions is not limited particularly in the invention but may be decided arbitrarily. If the number of protrusion portions is too small, it is however impossible to keep the sheets of paper sufficiently apart from one another and it is impossible to separate a sheet of paper surely from the stack. Accordingly, it is preferable that the number of protrusion portions is three or more.

The arm portions 52 have a function of supporting the protrusion portions 51 so that the protrusion portions 51 can always perform the aforementioned function, that is, the protrusion portions 51 can be engaged with the leading edges of the sheet Accordingly, the shape of each of the arm portions 52 is also not limited particularly as long as the shape allows this function to be performed. For example, in the sheet separation member 50 according to the invention as shown in FIGS. 8A and 8B or FIGS. 9A and 9B, each of the arm portions 52 supports the corresponding protrusion portion 51 nearly at the center of each of the arm portions 52.

The shape of each of the arm portions 52 is not limited to the examples shown in FIGS. 8A and 8B or in FIGS. 9A and 9B. For example, each arm portion 52 may be provided so as to support a plurality of protrusion portions or each arm portion 52 may be provided so as to support a plurality of protrusion portions at its ends. However, when the arm portions have one-to-one correspondence with the protrusion portions as shown in FIGS. 8A and 8B or FIGS. 9A and 9B so that the protrusion portions can be supported by the arm portions respectively, a load applied from the sheets of paper can be controlled in accordance with the protrusion portions. As a result, the sheets of paper can be separated stably without necessity of complicated design and manufacturing of the protrusion portions. Accordingly, multiple sheet feed can be prevented, that is, sheets of paper can be prevented from being fed collectively. From this point of view, it is preferable that some elasticity is given to each arm portion 52. It is also preferable that the shape of each arm portion 52 is decided in consideration of this point.

Although the arm portions 52 shown in the figures are formed to support the protrusion portions 51 from opposite sides, that is, from left and right sides, for example, in the sheet separation member 50 according to the embodiment as shown in FIGS. 8A and 8B, each of the arm portions 52 is not particularly limited to such a shape. For example, the arm portions 52 may be formed to support a plurality of protrusion portions 51 from either of the opposite sides alternately.

The plate spring portions 54 perform a function of supporting the body portion 53 (having the protrusion portions 51, and the arm portions 52) in a predetermined region (specifically, a sheet separation member storing space 22 which will be described later) of the sheet supply device 30. At the same time, the plate spring portions 54 perform a function of giving elasticity to the whole of the sheet separation member 50 to relax the pressure given from the sheets of paper engaged with the protrusion portions 51 to thereby make smooth separation possible. The sheet separation member 50 according to the invention has an important characteristic in that the plate spring portions 54 are formed so as to be integrated with the protrusion portions 51 and the arm portions 52. In this manner, the number of parts can be reduced, so that cost can be reduced.

The shape of each of the plate spring portions 54 in the invention is not limited particularly, that is, any shape can be used as the shape of each plate spring portion 54 as long as the shape allows the aforementioned functions to be performed. It is preferable that the plate spring portions 54 are formed to protrude obliquely from side edges 55 of the body portion 53 which are parallel with the sheet feeding direction, as shown in FIGS. 8A and 8B or FIGS. 9A and 9B. When the plate spring portions 54 are formed in this manner to protrude obliquely from the side edges 55 of the body portion 53 substantially exhibiting a rectangular shape, the whole of the body portion can be supported uniformly by the plate spring portions 54. In addition, when the sheet separation member 50 according to the invention is manufactured by pressing, the material can be used efficiently (cut-off portions due to the pressing can be reduced). Incidentally, in the invention, an angle at which each plate spring portion 54 protrudes from a corresponding side edge 55 of the body portion 53 is not limited particularly. The plate spring portions 54 may be formed obliquely to face forward in the direction (see the black arrow in FIG. 8A) of insertion of the sheet separation member 50 as shown in FIGS. 8A and 8B, or may be conversely formed obliquely to face rearward in the insertion direction of the sheet separation member 50 as shown in FIGS. 9A and 9B. In other words, the plate spring portions 54 may be formed obliquely to protrude from the body portion upward or downward in a sheet stacking direction.

The material of the sheet separation member 50 according to the invention is not limited particularly. Preferably, the sheet separation member 50 is made of metal. Specifically, a stainless steel plate, an aluminum plate, a copper plate or the like is preferably used. A method for manufacturing the sheet separation member 50 according to the invention is not particularly limited. Any method known in the related art can be used. For example, the sheet separation member 50 can be manufactured by pressing a stainless steel plate.

As shown in FIGS. 4 to 7, a long hole 21 is formed in the inclined surface 20 of the sheet supply device 30 according to the embodiment so as to extend in the conveyance direction of the sheet A (from the lower to the upper in FIG. 4). The storage space 22 for placing the sheet separation member 50 is provided on a rear side of the surface where the long hole 21 is formed, so that the protrusion portions 51 of the sheet separation member 50 according to the embodiment protrude toward a front side of the inclined surface 20.

Incidentally, when the storage space 22 is provided thus in the inclined surface 20 of the sheet supply device 30, it is possible to reduce the number of parts to thereby achieve cost reduction.

As is apparent from FIGS. 6 and 7, the storage space 22 is shaped like a box. The sheet separation member 50 has an external shape allowed to be stored in the storage space 22. The sheet separation member 50 is fixed in the storage space 22 through a fixation member 60 which is formed into a box shape allowed to receive the body portion 53 of the sheet separation member 50 inside.

That is, the fixation member 60 is formed so that the plate springs 54 protruding left and right from the body portion 53 of the sheet separation member 50 are supported by end surfaces of left and right side walls 62 opposite to each other. As a result, the fixation member 60 fixes the body portion 53 of the sheet separation member 50 in the storage space 22 while displaceably supporting the body portion 53 in the storage space 22.

Incidentally, the sheet separation member 50 is received in the storage space 22 in such a manner that the inclination angle of each of the protrusion portions 51 of the sheet separation member 50 to the inclined surface 20 becomes an obtuse angle in the conveyance direction of the sheet A and therefore the protrusion portions 51 do not disturb conveyance of the sheet A when the protrusion portions 51 protrude from the long hole 21 of the inclined surface 20. The amount of protrusion of each of the protrusion portions 51 from the inclined surface 20 when the sheet separation member 50 is stored thus in the storage space 22 is preferably selected to be in a range of from about 0.1 mm to about 0.4 mm.

As described above, in the sheet supply device 30 according to the embodiment, the long hole 21 is formed in the conveyance direction of the sheet A in the inclined surface 20 with which the leading edges of the sheets A are brought into contact at the time of sheet feed so that one of the sheet A is led to the conveyance path 5*a* by the protrusion portions 51 of the sheet separation member 50 protruded from the long hole 21. With this configuration, separation loads applied to the leading edges of the sheets A from the protrusion portions 51 at the time of sheet feed can be prevented from varying largely according to the number of sheets A stacked in the sheet storage portion 3*a*. When the separation loads are set to be equal to one another for the respective protrusion portions 51, the sheet A may not be fed well due to variation in the sheet A conveyance force of the sheet feed roller 8.

Figure 10A:
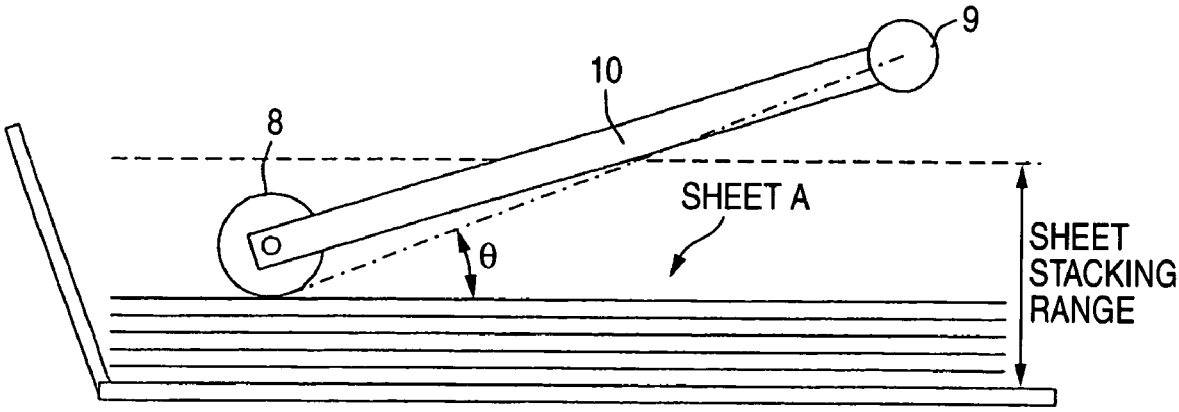
FIGS. 10A and 10B are explanatory views for explaining a sheet conveyance force of a sheet feed roller according to the embodiment.

That is, as shown in FIG. 10A, the sheet feed roller 8 according to the embodiment is a so-called pendulum type sheet feed roller which is provided at one end of the arm 10 while the other end of the arm 10 is pivoted by the driving shaft 9. Accordingly, when an angle θ formed between the plane of the sheet A and a line segment between a contact point between the sheet feed roller 8 and the sheet A and the driving shaft 9 changes in accordance with a change in the number of stacked sheets of paper A, a contact force applied to the sheet A from the sheet feed roller 8 changes.

The contact force increases as the number of stacked sheets of paper decreases from the maximum (the top position in the sheet stacking range shown in FIG. 10A) (in other words, as the angle θ increases). Accordingly, the conveyance force of the sheet A with rotation of the sheet feed roller 8 decreases as the number of stacked sheets of paper A increases (in other words, as the angle θ decreases) as shown in FIG. 10B.

As shown in FIGS. 2 and 3, an anti-slip member 3*c* constituted by a cork, etc. is provided in an opposite surface of the sheet storage portion 3*a* to the sheet feed roller 8 in the sheet supply device 30 so that multiple sheets of paper can be prevented from being fed collectively when the number of residual sheets of paper A becomes small.

Figure 10B:
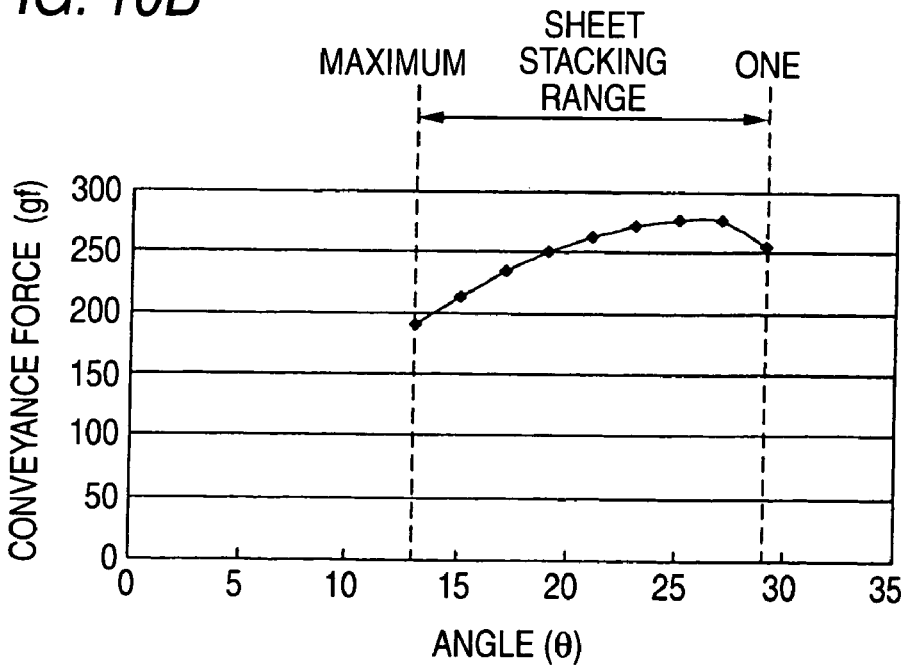

Therefore, the sheet A conveyance force of the sheet feed roller 8 decreases also when the number of sheets of paper A stacked in the sheet storage portion 3*a* decreases (i.e. when the angle θ is near the maximum angle) as shown in FIG. 10B.

Accordingly, in the sheet supply device 30 according to the embodiment, the separation loads applied to the leading edges of the sheets A from the protrusion portions 51 constituting the sheet separation member 50 are preferably set in accordance with characteristic of the sheet A conveyance force of the sheet feed roller 8 shown in FIG. 10B. That is, the separation load for each protrusion portion 51 constituting the sheet separation member 50 is preferably set in accordance with the number of stacked sheets of paper A in the sheet storage portion 3*a* so that the separation load decreases as the number of the stacked sheets of paper A increases and as the number of stacked sheets of paper residual in the sheet storage portion 3*a* decreases.

To this end, the spring constants of the arm portions 52 supporting the protrusion portions 51 respectively in the sheet separation member 50 may be set individually by adjusting the widths, plate thicknesses, or the like of the arm portions 52. Setting the spring constants of the arm portions 52 individually is however very laborious.

Figure 11A:
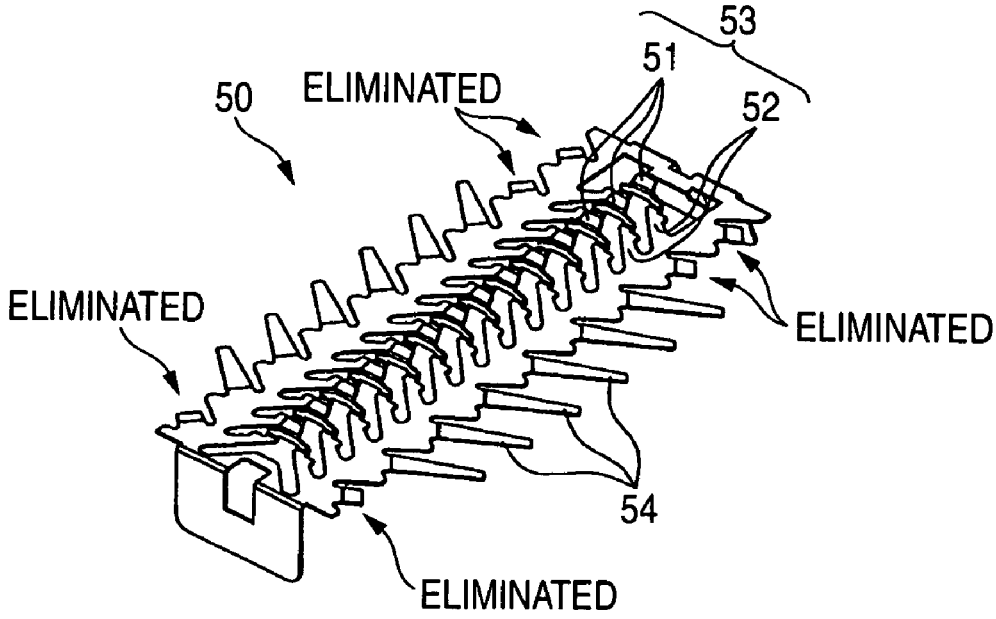
FIGS. 11A and 11B are perspective views showing the practical configurations of the sheet separation member and a fixation member according to the embodiment.
Figure 11B:
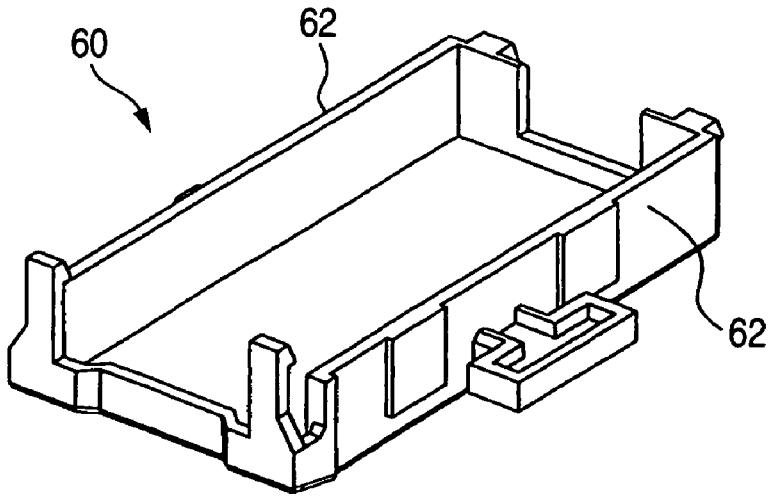

In this embodiment, a sheet separation member 50 shown in FIG. 11A and obtained by changing the basic configuration shown in FIGS. 8A and 8B is practically used as the sheet separation member 50. The sheet separation member 50 is fixed in a storage space 22 through a fixation member 60 in which the whole regions of side walls 62 are set to have a uniform height, as shown in FIG. 11B.

That is, as shown in FIG. 11A, when two pairs of plate springs 54 (two for left and two for right, that is, four in total) located on a sheet-A-stacking-direction upper side and one pair of left and right plate springs 54 located on a sheet-A-stacking-direction lower side are eliminated from plate springs 54 protruded at substantially equal intervals from left and right side edges 55 of a body portion 53 for supporting the body portion 53 in the sheet separation member 50, arrangement density of the plate springs 54 is reduced on the sheet-A-stacking-direction upper and lower sides so that a separation load of each of protrusion portions 51 located on the sheet-A-stacking-direction upper and lower sides is smaller than a separation load of any protrusion portion 51 located in a sheet-A-stacking-direction center portion.

As a result, in the sheet supply device 30 according to the embodiment, the separation loads applied to the leading edges of the sheets A from the protrusion portions 51 constituting the sheet separation member 50 can be set very easily in accordance with the sheet A conveyance force of the sheet feed roller 8, so that the sheets A stacked in the sheet storage portion 3*a* can be fed one by one surely without causing no feed or multiple sheet feed.

Because the sheet separation member 50 according to the embodiment is formed by pressing a metal plate, the respective parts in the sheet separation member 50 are formed integrally. With this configuration, the sheet separation member 50 can be achieved easily without necessity of complicated design and manufacturing of the protrusion portions 51. Moreover, it is possible to reduce the total number of parts in the sheet supply device 30 to thereby improve manufacturing efficiency and it is possible to reduce the cost of the sheet separation member 50.

At the time of sheet feed, sheet powder may be generated due to friction between the sheet A to be fed and the protrusion portions 51. Because most of the sheet powder falls down through gaps between the arm portions 52, it is possible to reduce the influence of the generated sheet powder on sheet separation.

Although the embodiment of the invention has been described above, the invention is not limited to the aforementioned embodiment but may use various modes without departing from the gist of the invention.

Figure 12A:
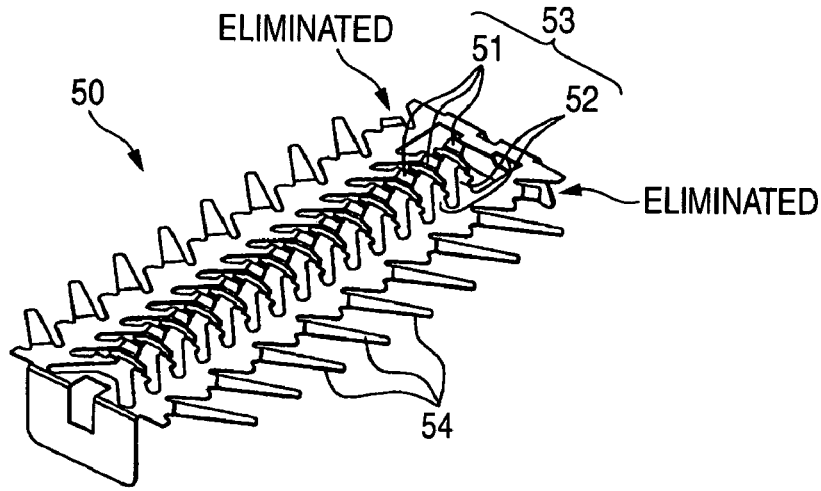
FIGS. 12A-12C are perspective views showing a modification of the sheet separation member depicted in FIGS. 11A and 11B.
Figure 12B:
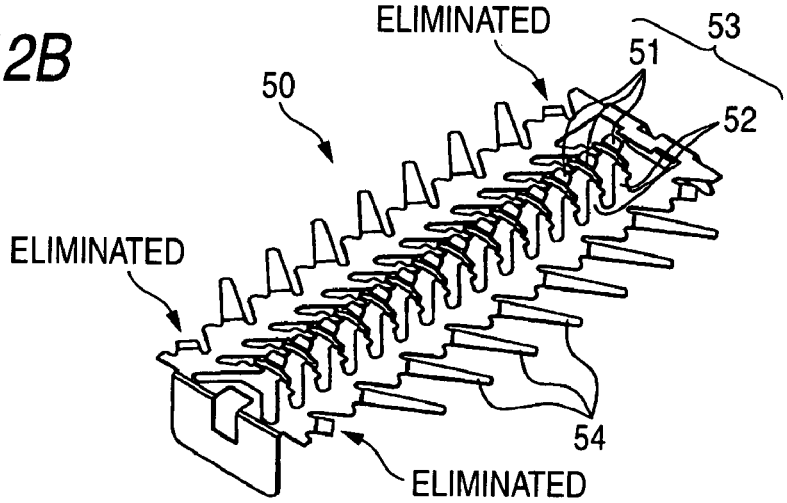
Figure 12C:
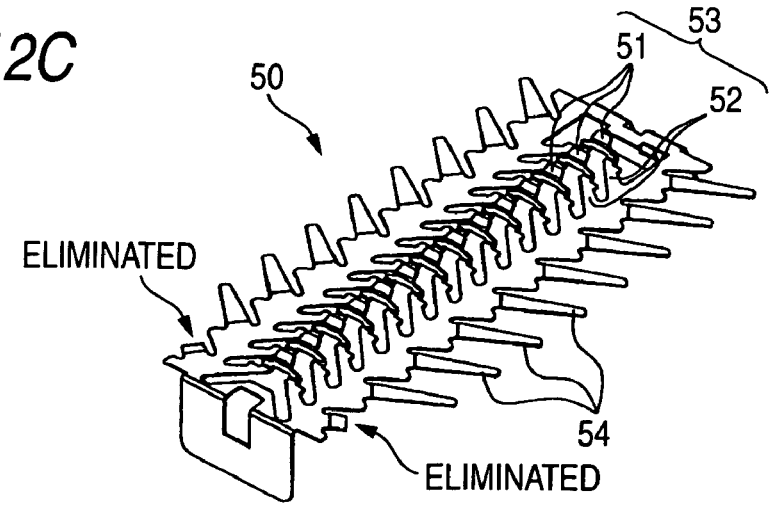

For example, the embodiment has been described on the case where the sheet separation member 50 is produced by eliminating two pairs of plate springs 54 (two for left and two for right, that is, four in total) located on the sheet-A-stacking-direction upper side and eliminating one pair of left and right plate springs 54 located on the sheet-A-stacking-direction lower side from the spring plates 54 protruded from the left and right side edges 55 of the body portion 53 at substantially equal intervals for supporting the body portion 53. Alternatively, the separation load of the protrusion portion 51 disposed on the sheet-A-stacking-direction upper or lower side may be reduced in accordance with lowering of the sheet A conveyance force of the sheet feed roller 8 by a method of eliminating one pair of left and right plate springs 54 located on the sheet-A-stacking-direction upper side as shown in FIG. 12A, by a method of eliminating two pair of left and right plate springs 54 located on the sheet-A-stacking-direction upper and lower sides as shown in FIG. 12B, or by a method of eliminating one pair of left and right plate springs 54 located on the sheet-A-stacking-direction lower side as shown in FIG. 12C. Thus, it is possible to prevent a failure in sheet feed caused by a change in the sheet A conveyance force of the sheet feed roller 8.

The sheet separation members 50 shown in FIGS. 11A, 11B and 12A-12C are described on the assumption that the spring plates 54 are protruded from the left and right side edges 55 of the body portion 53 at substantially equal intervals. By changing a protrusion interval, arrangement density of the plate springs 54 on the sheet-A-stacking-direction upper or lower side can be reduced so that the separation load of the protrusion portion 51 disposed on the sheet-A-stacking-direction upper or lower side may be made smaller than the separation load of any protrusion portion 51 in the sheet-A-stacking-direction center portion.

Figure 13A:
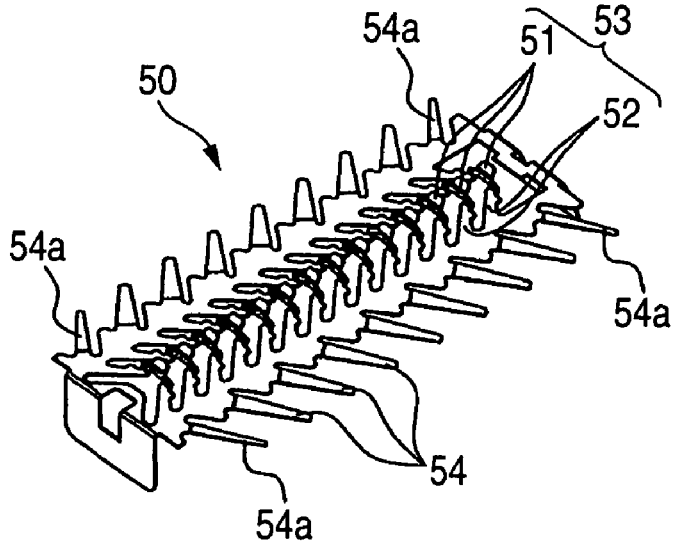
FIGS. 13A and 13B are perspective views showing another modification of the sheet separation member depicted in FIGS. 11A and 11B.
Figure 13B:
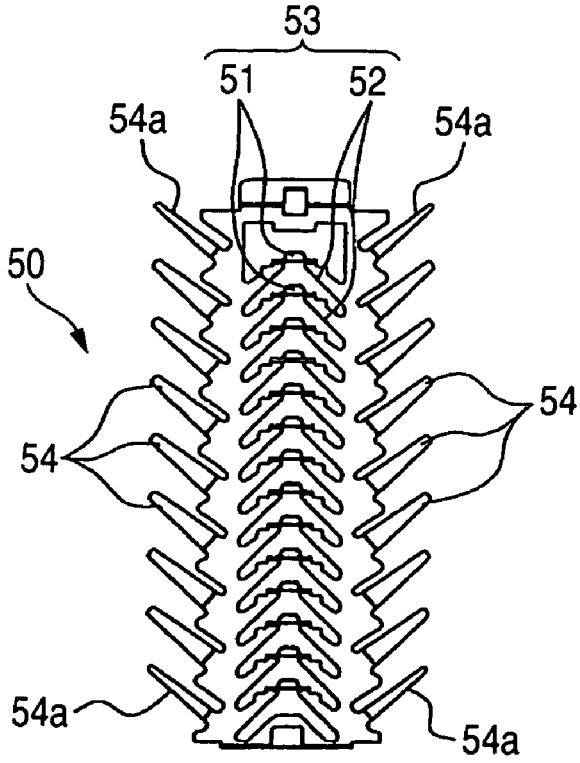

Alternatively, as shown in FIGS. 13A and 13B, in a sheet separation member 50, plate springs 54 are protruded at substantially equal intervals from left and right side edges 55 of a body portion 53 and the width of each of plate springs 54*a* located in sheet-A-stacking-direction upper and lower sides is made smaller than the width of any plate spring 54 in the sheet-A-stacking-direction center portion so as to reduce the spring constant of the plate spring 54*a*.

Figure 14A:
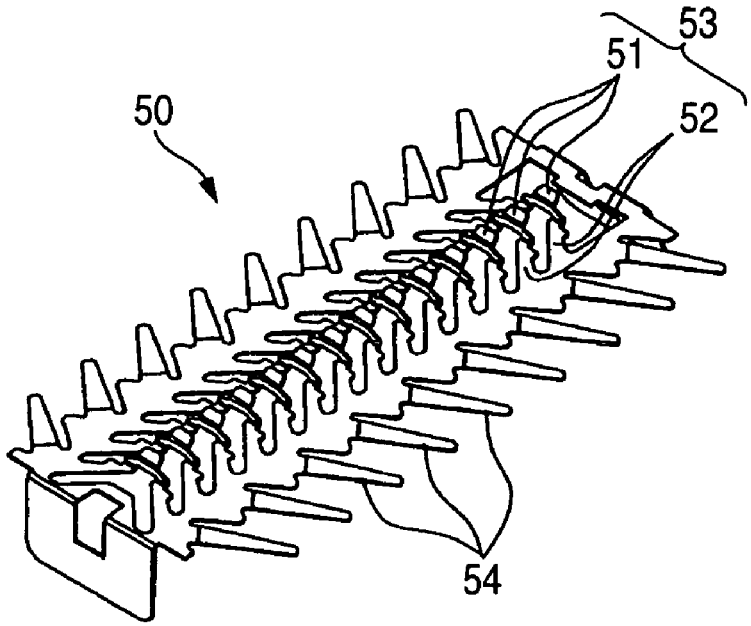
FIGS. 14A and 14B are perspective views showing modifications of the sheet separation member and the fixation member depicted in FIGS. 11A and 11B.
Figure 14B:
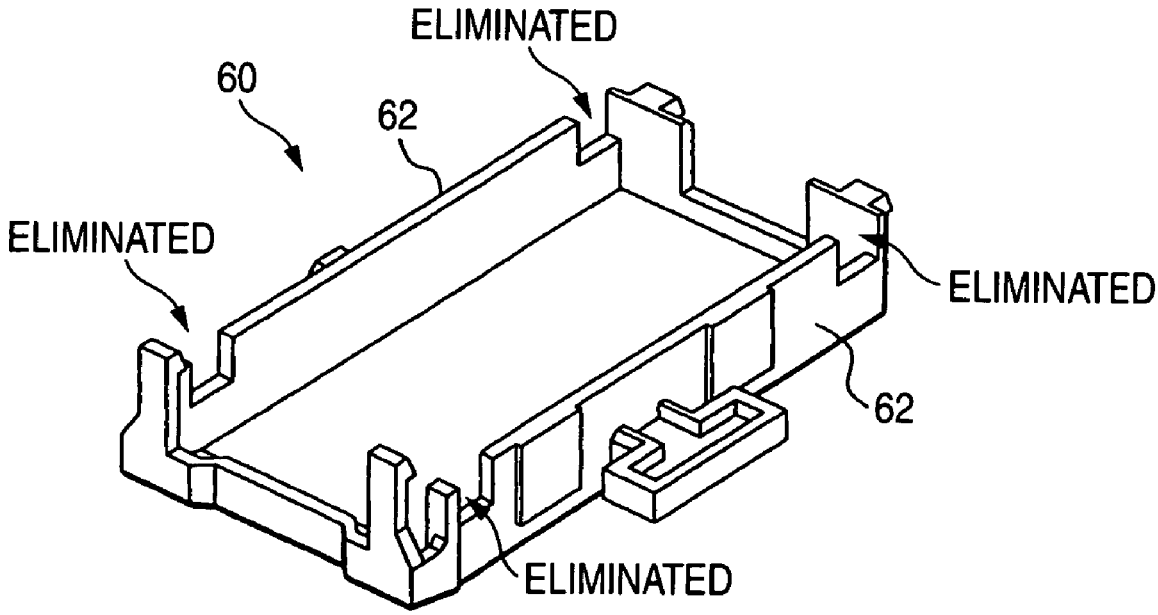
Figure 15A:
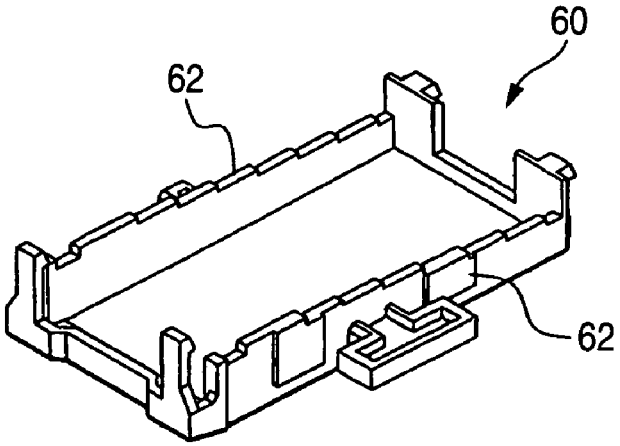
FIGS. 15A and 15B are explanatory views showing other modifications of the sheet separation member and the fixation member depicted in FIGS. 11A and 11B.
Figure 15B:
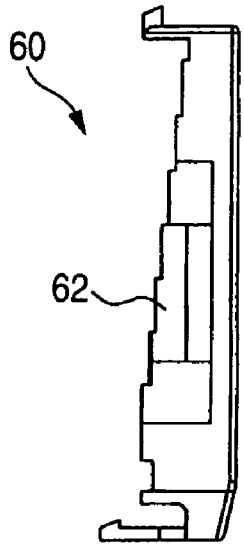
Figure 16A:
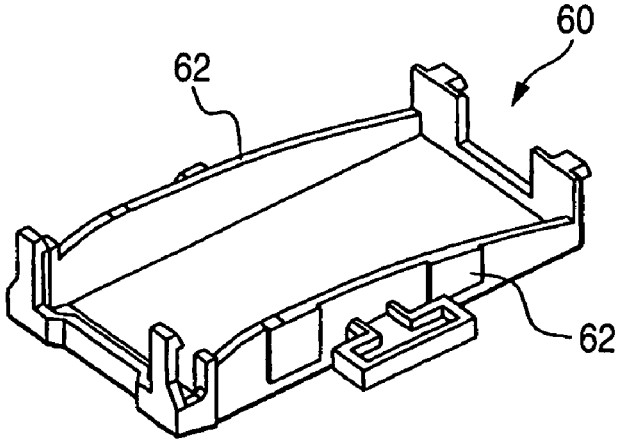
FIGS. 16A and 16B are explanatory views showing other modifications of the sheet separation member and the fixation member depicted in FIGS. 11A and 11B.
Figure 16B:
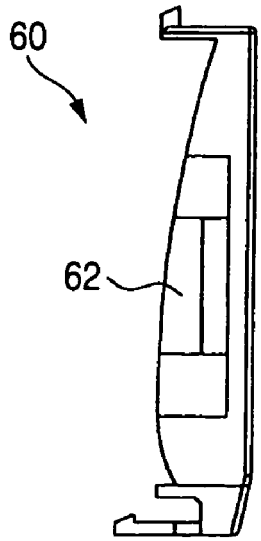
Figure 17A:
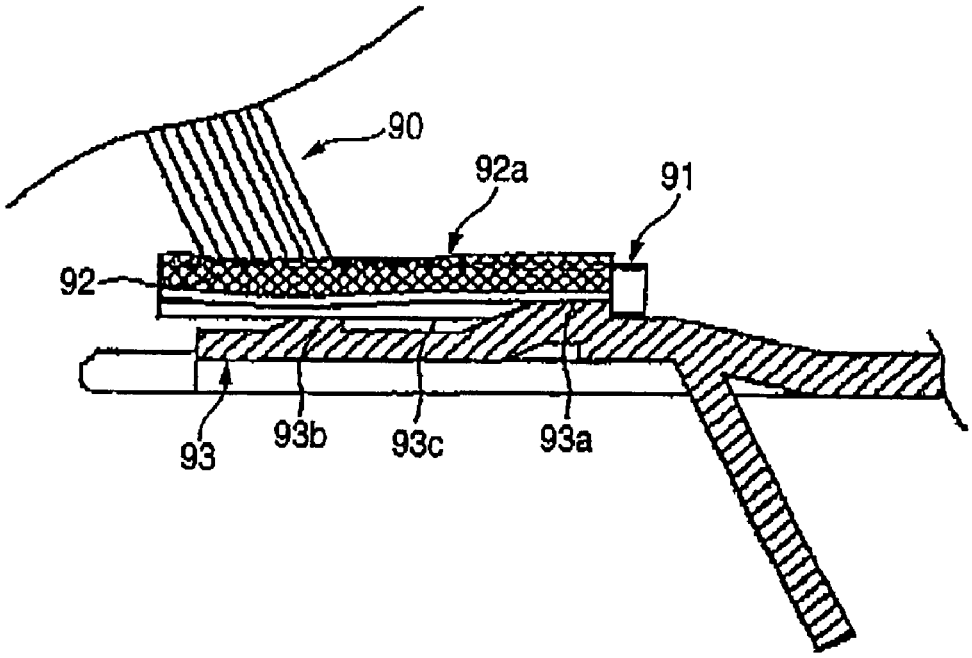
FIG. 17A RELATED ART
FIGS. 17A and 17B are explanatory views showing a sheet separation member in a sheet supply device according to the related art.
Figure 17B:
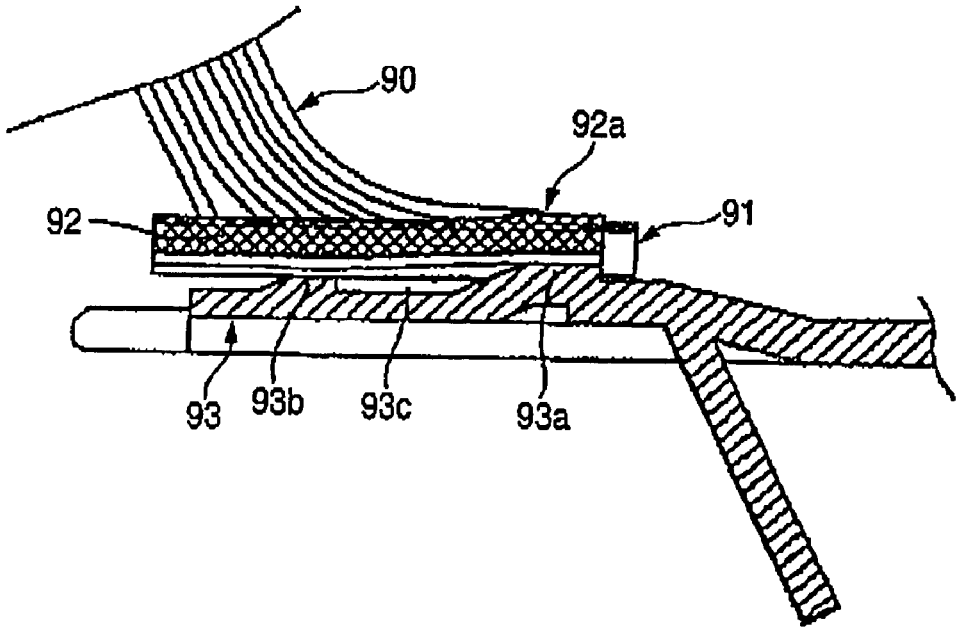
FIG. 17B RELATED ART
Figure 18A:
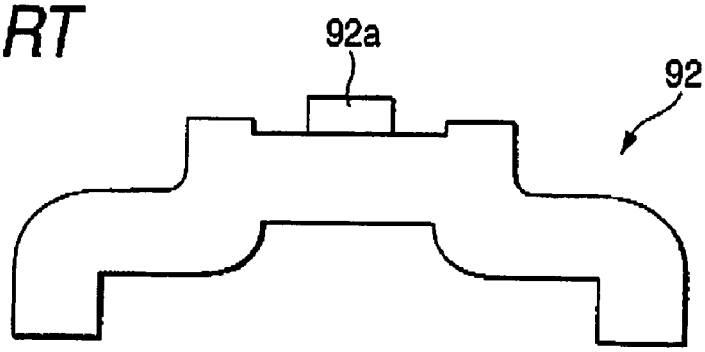
FIG. 18A RELATED ART
FIGS. 18A-18C are explanatory views showing the sheet separation member in the sheet supply device according to the related art.
Figure 18B:
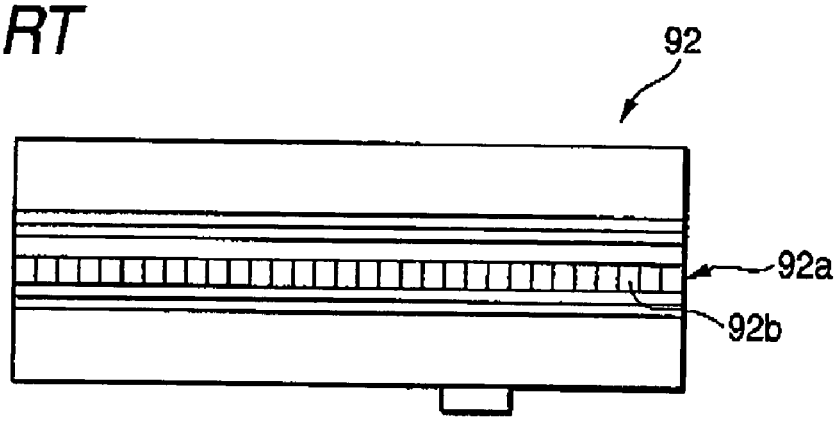
FIG. 18B RELATED ART
Figure 18C:
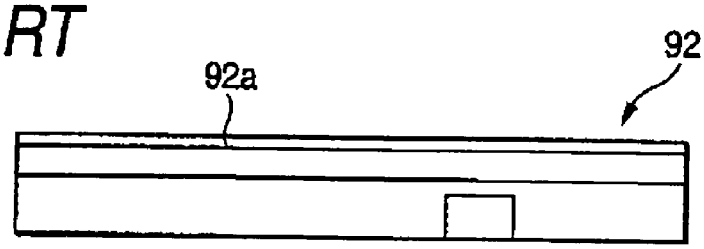
FIG. 18C RELATED ART

On the other hand, in order to make a separation load of a protrusion portion 51 located on the sheet-A-stacking-direction upper or lower side smaller than a separation load of any protrusion portion 51 in a sheet-A-stacking-direction center portion among protrusion portions 51 constituting the sheet separation member 50, the following method may be used by way of example without necessity of adjustment of the spring constants on the sheet separation member 50 side. That is, plate springs 54 are protruded at substantially equal intervals from left and right side edges 55 of a body portion 53 in a sheet separation member 50 as shown in FIG. 14A and parts (specifically, on the sheet-A-stacking-direction lower or upper sides) of a pair of left and right side walls 62 of a fixation member 60 for supporting the plate springs 54 of the sheet separation member 50 are cut off as shown in FIG. 14B.

That is, when the opposite ends of each of the side walls 62 of the fixation member 60 are cut off in this manner, the plate springs 54 located on the sheet-A-stacking-direction upper and lower sides among the plate springs 54 constituting the sheet separation member 50 are not supported by the fixation member 60 so that the spring constants of the plate springs 54 on the sheet-A-stacking-direction upper and lower sides are reduced. Accordingly, it is possible to obtain the same advantage as that in the embodiment.

Incidentally, for the shape (in other words, height) of each side wall 62 of the fixation member 60 to be adjusted thus, the height of the side wall 62 may be changed stepwise or continuously, as shown in FIGS. 15A and 15B or FIGS. 16A and 16B, in accordance with a change of the conveyance force of the sheet feed roller 8 shown in FIG. 10B. Accordingly, it is possible to improve characteristic of separation and feed of the sheet A.

On the other hand, although the embodiment has been described on the case where the invention is applied to a printer of a multifunction machine, the invention can be applied to any apparatus such as a copying machine or a facsimile in the same manner as the embodiment and obtain the same advantage as that in the embodiment, as long as the apparatus includes a sheet supply device for separating and feeding sheets of paper stored in a stack state one by one.

The embodiment has been described about the sheet supply device where sheets of paper A on the stacking-direction upper side (i.e. vertical-direction upper side) are separated and fed one by one to the printer while the sheets A are stacked substantially vertically with the sheet plane being set horizontally in the sheet supply cassette 3 disposed in the lower portion of the printer. For example, the invention can be applied, in the same manner as the embodiment to obtain the same advantage as that in the embodiment, to a sheet supply device in which sheets A on a stacking-direction upper side (i.e. obliquely upper side) are separated and fed one by one to the printer while the sheets A are stacked obliquely with the sheet plane being set obliquely in a sheet storage portion disposed in the rear of a printer.

In this specification, the sheet supply device is described as a device for supplying "sheets of paper" in an apparatus and the sheet separation member is described as a member for separating the "sheets of paper" one by one. The "sheets of paper" are not limited to paper but may include plastic films (so-called resin sheets) such as OHP films, laminated sheets made of resin and paper, and various kinds of sheets. The invention can be applied to any sheet supply device for supplying the resin sheets or laminated sheets other than paper and to any sheet separation member in the same manner as the embodiment and obtain the same advantage as that in the embodiment.

According to the embodiment, in the sheet separation member for use in the sheet supply device including the sheet feed roller for feeding stacked sheets, the protrusion portions are supported by the arm portions. With this configuration, a load applied to the respective protrusion portions is divided and supported by the arm portions so that the load from the sheets can be controlled in accordance with each of the protrusion portions supported by the arm portions. As a result, stable sheet separation can be attained without necessity of complicated design and manufacturing of the protrusion portions, and multiple sheet feed can be prevented (i.e. a plurality of sheets can be prevented from being fed collectively).

Sheet powder may be generated due to friction between the sheets to be fed and the protrusion portions at the time of sheet feed. Most of the sheet powder falls down through gaps between the arm portions, so that the influence of the generated sheet powder on sheet separation can be reduced.

In the sheet separation member according to the embodiment, the body portion constituted by the protrusion portions and the arm portions is formed so as to be integrated with the plate spring portions for supporting the body portion in a predetermine region of the sheet supply device. With this configuration, the "sheet separation portion and separation portion supporting portion" included in the sheet separation member according to the related art are formed by one member in the sheet separation member according to the invention. As a result, it is possible to reduce the total number of parts, improve manufacturing efficiency and reduce cost.

According to the embodiment, the plate spring portions are formed to protrude obliquely from the side edges of the body portion, the side edges being parallel to the sheet feeding direction. With this configuration, the whole of the body portion can be pressed against the predetermined region of the sheet supply device by a uniform force.

According to the embodiment, the sheet separation member is made of metal (i.e. the protrusion portions, the arm portions and the plate spring portions are all made of metal). With this configuration, unlike the sheet separation portion made of resin according to the related art, the shape of each of the protrusion portions is unlikely to deform due to a temperature condition, a humidity condition etc., and the sheet separation member is unlikely to wear even after used for a long term. Thus, the sheet separation member can be given durability.

According to the embodiment, the sheet supply device includes: a sheet storage portion for storing a plurality of sheets; a sheet feed roller for feeding the sheets stored in the sheet storage portion to a predetermined conveyance path; and an inclined surface located in the predetermined conveyance path and inclined at an obtuse angle with respect to the sheets stored in the sheet storage portion; wherein a long hole is formed in the inclined surface so as to extend in a sheet conveyance direction; and the sheet separation member is mounted in the sheet supply device so that protrusion portions of the sheet separation member pass through the long hole and protrude from the inclined surface. With this configuration, the sheet separation member according to the invention having various advantages as described above can be used in the sheet supply device and the "holder portion" included in the sheet separation member according to the related art is formed so as to be integrated with the inclined surface of the sheet supply device. Accordingly, it is not necessary to manufacture the holder portion individually and separately. As a result, it is possible to reduce the total number of parts.

According to the embodiment, there is provided a sheet separation member used in a sheet supply device for separating and feeding stacked sheets of paper one by one by rotation of a pendulum type sheet feed roller, the sheet supply device including the sheet feed roller brought into contact with a sheet plane by an urging force received from a long support member having one end pivoted and the other end attached to the sheet feed roller, the sheet separation member including: a body portion including a plurality of protrusion portions that engages with leading edges of the sheets of paper in a sheet feeding direction, and a plurality of arm portions supporting the protrusion portions respectively so that the protrusion portions are disposed at intervals in a stacking direction of the sheet A and plate spring portions formed around the body portion and integrally with the body portion in an arrangement direction of the protrusion portions so as to support the body portion in a predetermined region of the sheet supply device; wherein: separation loads applied to the sheets of paper from the protrusion portions engaged with the leading edges of the sheets of paper when one of the sheets of paper is fed by rotation of the sheet feed roller are set so that a separation load from a protrusion portion on a sheet-stacking-direction upper side is smaller than a separation load from any protrusion portion in an arrangement-direction center portion.

That is, in the sheet supply device including the pendulum type sheet feed roller, the sheet feed roller is brought into contact with the uppermost plane of the stacked sheets of paper by an urging force applied to the sheet feed roller from the support member. On this occasion, a contact force applied perpendicularly to the sheet surface from the sheet feed roller varies according to an angle between a longitudinal axis of the support member and the sheet plane (in other words, according to the number of stacked sheets of paper).

The contact force increases as the number of stacked sheets of paper decreases from the maximum (in other words, as the angle between the longitudinal axis of the support member and the sheet plane increases).

For this reason, the sheet conveyance force of the sheet feed roller decreases as the number of stacked sheets of paper increases and the position of the sheet of paper to be fed increases in level.

In the sheet separation member according to the embodiment, the separation loads applied to the corresponding sheets of paper from the protrusion portions disposed in the sheet stacking direction are set so that the separation load from the protrusion portion located on the sheet-stacking-direction upper side is smaller than the separation load from any protrusion portion in the arrangement-direction center portion. With this configuration, the separation loads of the respective protrusion portions are changed correspondingly to the sheet conveyance force of the sheet feed roller.

Accordingly, according to the sheet separation member described with respect to the embodiment, the stacked sheets of paper, particularly, sheets of paper ranging from the center portion to the upper side in the sheet stacking direction can be fed one by one surely without causing multiple sheet feed or no feed.

The protrusion portions are supported by the arm portions correspondingly, and the body portion constituted by the protrusion portions and the arm portions is supported by the plate springs formed in the arrangement direction of the protrusion portions, so that the separation loads applied to the sheets of paper from the protrusion portions can be set easily by adjusting the spring constants of the arm portions supporting the protrusion portions or the spring constants of the plate springs supporting the body portion. As a result, the sheet separation member according to the invention can be achieved easily without necessity of complicate design and manufacturing of the protrusion portions.

The body portion constituted by the protrusion portions and the arm portions are formed so as to be integrated with all the plate spring portions supporting the body portion, so that the "sheet separation portion and separation portion supporting portion" included in the sheet separation member according to the related art are formed by one member in the sheet separation member according to the invention. As a result, it is possible to reduce the total number of parts to thereby improve manufacturing efficiency, and it is possible to reduce cost of the sheet separation member.

At the time of sheet feed, sheet powder may be generated due to friction between the sheets of paper to be fed and the protrusion portions. Because most of the sheet powder falls down through gaps between the arm portions, it is possible to reduce the influence of the generated sheet powder on sheet separation.

According to the embodiment, there is provided a sheet separation member used in a sheet supply device for separating and feeding stacked sheets of paper one by one by rotation of a pendulum type sheet feed roller, the sheet supply device including the sheet feed roller brought into contact with a sheet plane by an urging force received from a long support member having one end pivoted and the other end attached to the sheet feed roller, the sheet separation member including: a body portion including a plurality of protrusion portions that engages with leading edges of the sheets of paper in a sheet feeding direction, and a plurality of arm portions supporting the protrusion portions respectively so that the protrusion portions are disposed at intervals in a stacking direction of the sheet A and plate spring portions formed around the body portion and integrally with the body portion in an arrangement direction of the protrusion portions so as to support the body portion in a predetermined region of the sheet supply device; wherein: separation loads applied to the sheets of paper from the protrusion portions engaged with the leading edges of the sheets of paper when one of the sheets of paper is fed by rotation of the sheet feed roller are set so that a separation load from a protrusion portion on a sheet-stacking-direction lower side is smaller than a separation load from any protrusion portion in an arrangement-direction center portion.

That is, in the sheet supply device including the pendulum type sheet feed roller, an anti-slip member constituted by a cork, etc. is provided in a bottom portion opposite to the sheet feed roller with respect to the sheets of paper so that multiple sheets of paper can be generally prevented from being fed collectively when the number of residual sheets of paper becomes small in the sheet storage portion storing the sheets of paper in a stack state. With this configuration, the sheet conveyance force of the sheet feed roller decreases when the number of residual stacked sheets of paper decreases (in other words, when an angle between the longitudinal axis of the support member and the sheet plane is near the maximum angle).

In the sheet separation member described above with respect to the embodiment, the separation loads applied to the corresponding sheets of paper from the protrusion portions disposed in the sheet stacking direction are set so that the separation load from the protrusion portion on the sheet-stacking-direction lower side is smaller than the separation load from any protrusion portion located in the arrangement-direction center portion. With this configuration, the separation loads of the respective protrusion portions are changed correspondingly to the sheet conveyance force of the sheet feed roller.

Accordingly, according to the sheet separation member described above with respect to the embodiment, multiple sheet feed or no feed generated when the number of residual stacked sheets of paper is small can be prevented so that the sheets of paper can be fed one by one surely.

The protrusion portions are supported by the arm portions correspondingly, the body portion constituted by the protrusion portions and the arm portions is supported by the plate springs formed in the arrangement direction of the protrusion portions, and the plate springs are formed so as to be integrated with the body portion. With this configuration, the sheet separation member can be achieved easily without necessity of complicated design and manufacturing of the protrusion portions in the same manner as in the aforementioned sheet separation member. At the same time, it is possible to improve manufacturing efficiency so as to achieve low cost of the sheet separation member and it is possible to reduce the influence of sheet powder generated at the time of sheet feed, on sheet separation.

Further, according to the embodiment, there is provided a sheet separation member used in a sheet supply device for separating and feeding stacked sheets of paper one by one by rotation of a pendulum type sheet feed roller, the sheet supply device including the sheet feed roller brought into contact with a sheet plane by an urging force received from a long support member having one end pivoted and the other end attached to the sheet feed roller, the sheet separation member including: a body portion including a plurality of protrusion portions that engages with the sheets of paper in a sheet feeding direction, and a plurality of arm portions supporting the protrusion portions respectively so that the protrusion portions are disposed at intervals in a stacking direction of the sheet And plate spring portions formed around the body portion and integrally with the body portion in an arrangement direction of the protrusion portions so as to support the body portion in a predetermined region of the sheet supply device; wherein: separation loads applied to the sheets of paper from the protrusion portions engaged with the leading edges of the sheets of paper when one of the sheets of paper is fed by rotation of the sheet feed roller are set so that a separation load from each of protrusion portions on sheet-stacking-direction upper and lower sides is smaller than a separation load from any protrusion portion in an arrangement-direction center portion.

Accordingly, in the sheet separation member, the separation loads applied to the corresponding sheets of paper from the protrusion portions disposed in the sheet stacking direction are set so that the separation load from each of the protrusion portions on sheet-stacking-direction upper and lower sides is smaller than the separation load from any protrusion portion in the arrangement-direction center portion.

As a result, according to the sheet separation member, the sheets of paper stored in the sheet storage portion of the sheet supply device can be always fed one by one surely regardless of the number of stacked sheets of paper so that multiple sheet feed or no feed can be prevented more surely from being generated at the time of sheet feed.

Accordingly, the sheet separation member can be achieved easily without necessity of complicated design and manufacturing of the protrusion portions. At the same time, it is possible to improve manufacturing efficiency so as to achieve low cost of the sheet separation member and it is possible to reduce the influence of sheet powder generated at the time of sheet feed, on sheet separation.

The sheet separation member may be formed from synthetic resin. It is preferable that the protrusion portions, the arm portions and the plate spring portions are all formed integrally from metal.

That is, when the sheet separation member is formed from metal, unlike the sheet separation portion made of resin according to the related art, the shape of each of the protrusion portions is unlikely to deform due to a temperature condition, a humidity condition etc., and the sheet separation member is unlikely to wear even after used for a long term. Thus, the sheet separation member can be given durability.

In order to set the separation loads applied to the sheets of paper from the protrusion portions, spring constants of the arm portions may be set individually, for example, by changing widths of the arm portions supporting the protrusion portions respectively.

Moreover, because the arm portions are provided for supporting the protrusion portions respectively and setting the arrangement positions of the protrusion portions, it is conceived that setting the spring constants of the arm portions individually is extremely laborious and the protrusion portions may not be supported well due to the setting of the spring constants.

In the sheet separation member, the separation loads of the protrusion portions may be set not by changing the spring constants of the arm portions directly supporting the protrusion portions but by changing the spring constants of the plate spring portions supporting the whole of the body portion constituted by the protrusion portions and the arm portions in the arrangement direction of the protrusion portions.

That is, according to the embodiment, the separation loads of the protrusion portions are configured by setting the spring constants of the plate spring portions provided in the arrangement direction of the protrusion portions (in other words, in the sheet stacking direction) in such a manner that a spring constant of a plate spring portion on a sheet-stacking-direction upper or lower side is smaller than a spring constant of any plate spring portion in a sheet-stacking-direction center portion.

Accordingly, the sheet separation member can be achieved easily compared with the case where the spring constants of the respective arm portions are adjusted individually.

The separation loads of the protrusion portions may be configured as follows.

That is, when the plate spring portions are constituted by a plurality of plate springs disposed on the body portion at intervals in the arrangement direction of the protrusion portions, the separation loads of the protrusion portions may be set by changing spring constants of the plate springs constituting the plate spring portions in the arrangement direction of the protrusion portions.

Or the separation loads of the protrusion portions may be set by changing arrangement density of the plate springs in the arrangement direction of the protrusion portions.

Specifically, for example, in order to set the separation loads of the protrusion portions, the width of each of the plate springs disposed on the sheet-stacking-direction upper or lower side may be reduced, compared with the width of any plate spring in the sheet-stacking-direction center portion, among the plate springs constituting the plate spring portions, and hence, the spring constant of the plate spring disposed on the sheet-stacking-direction upper or lower side may be reduced. With this configuration, the separation loads of the protrusion portions can be set easily.

For example, in order to set the separation loads of the protrusion portions, the arrangement density of the plate springs disposed on the sheet-stacking-direction upper or lower side may be reduced, compared with the arrangement density of the plate springs on the sheet-stacking-direction center portion, among the plate springs constituting the plate spring portions.

Incidentally, for the arrangement density of the plate springs to be changed, the interval between adjacent ones of the plate springs may be adjusted or the plate springs formed at substantially equal intervals may be partially eliminated.

In order to set the separation loads applied to the sheets of paper from the protrusion portions, the spring constants of the plate springs may be changed in the arrangement direction of the protrusion portions.

When the sheet separation member includes a fixation member shaped like a box in which the body portion can be received so that the fixation member supports the plate spring portions at end surfaces of its opposite side walls so as to fix the body portion to the sheet supply device while displaceably supporting the body portion, the separation loads of the protrusion portions may be set by changing a height of each of the side walls of the fixation member in the arrangement direction of the protrusion portions, the side walls supporting the plate spring portions.

That is, when the height of each of the side walls for supporting the plate spring portions in the fixation member is set so that the height of a section of the side wall on a sheet-stacking-direction upper or lower side is smaller than the height of a section of the side wall in a protrusion-portion-arrangement-direction center portion, the separation loads of the protrusion portions can be set so that a separation load of a protrusion portion on the sheet-stacking-direction upper or lower side is smaller than a separation load of any protrusion portion on the arrangement-direction center portion. With this configuration, the separation loads of the protrusion portions may be set by changing the height of each of the side walls for supporting the plate spring portions in the fixation member as described above.

According to the embodiment, there is provided a sheet supply device including: a sheet storage portion for receiving sheets of paper in a stack state; a pendulum type sheet feed roller attached to the other end of a long support member while one end of the long support member is pivoted, the pendulum type sheet feed roller being brought into contact with an uppermost plane of the sheets of paper stored in the sheet storage portion by an urging force received from the support member; and an inclined surface inclined at an obtuse angle with respect to the sheets of paper stored in the sheet storage portion on a downstream side in a feeding direction of the sheets paper by rotation of the sheet feed roller; wherein: a long hole is formed in the inclined surface in a stacking direction of the sheets of paper in the sheet storage portion; and the sheet separation member is provided so that protrusion portions of the sheet separation member pass through the long hole and protrude from the inclined surface.

According to the sheet supply device configured thus, the sheet separation member is used to cooperate with a pendulum type sheet feed roller to separate and feed stacked sheets of paper one by one. With this configuration, it is possible to feed sheets of paper one by one surely regardless of the number of the sheets of paper stored in the sheet storage portion.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. A sheet separation member for use in a sheet supply device including a sheet feed roller that feeds stacked sheets, the sheet separation member comprising:

a body portion including a plurality of protrusion portions integrally formed with the body portion, the plurality of protrusion portions configured to engage with leading edges of the stacked sheets in a sheet feeding direction, and a plurality of arm portions that support the protrusion portions in positions where the protrusion portions are engaged with the leading edges of the sheets, the plurality of protrusion portions being movable with respect to each other; and a plurality of plate spring portions integrally formed with the body portion to support the body portion in a predetermined region of the sheet supply device.

2. A sheet separation member for use in a sheet supply device including a sheet feed roller that feeds stacked sheets, the sheet separation member comprising:

a body portion including a plurality of protrusion portions integrally formed with the body portion, the plurality of protrusion portions configured to engage with leading edges of the stacked sheets in a sheet feeding direction, and a plurality of arm portions that support the protrusion portions in positions where the protrusion portions are engaged with the leading edges of the sheets; and a plurality of plate spring portions integrally formed with the body portion to support the body portion in a predetermined region of the sheet supply device, wherein the plate spring portions are formed to protrude obliquely from both side edges of the body portion, the side edges being parallel with the sheet feeding direction.

3. The sheet separation member according to claim 2, wherein the plate spring portions are formed to protrude obliquely from the side edges of the body portion upward in a sheet stacking direction.

4. The sheet separation member according to claim 2, wherein the plate spring portions are formed to protrude obliquely from the side edges of the body portion downward in a sheet stacking direction.

5. The sheet separation member according to claim 1, wherein the sheet separation member is made of metal.

6. A sheet separation member for use in a sheet supply device including a sheet feed roller that feeds stacked sheets, the sheet separation member comprising:

a body portion including a plurality of protrusion portions integrally formed with the body portion, the plurality of protrusion portions configured to engage with leading edges of the stacked sheets in a sheet feeding direction, and a plurality of arm portions that support the protrusion portions in positions where the protrusion portions are engaged with the leading edges of the sheets; and a plurality of plate spring portions integrally formed with the body portion to support the body portion in a predetermined region of the sheet supply device, wherein each of the arm portions supports a corresponding one of the protrusion portions so that the protrusion portions are disposed at intervals in a stacking direction of the sheets.

7. The sheet separation member according to claim 1, wherein the plate spring portions are formed around the body portion along an arrangement direction of the protrusion portions.

8. A sheet separation member for use in a sheet supply device including a sheet feed roller that feeds stacked sheets, the sheet separation member comprising:

a body portion including a plurality of protrusion portions that engages with leading edges of the stacked sheets in a sheet feeding direction, and a plurality of arm portions that support the protrusion portions in positions where the protrusion portions are engaged with the leading edges of the sheets; and a plurality of plate spring portions integrally formed with the body portion to support the body portion in a predetermined region of the sheet supply device, wherein a separation load applied from the protrusion portions being disposed at at least one of an upper side and a lower side with respect to a stacking direction of the sheets to one of the sheets that is fed by rotation of the sheet feed roller is configured to be smaller than a separation load applied from the protrusion portions being disposed at a center portion of the body portion with respect to the stacking direction of the sheets to the sheet fed by rotation of the sheet feed roller.

9. The sheet separation member according to claim 8, wherein the separation loads applied from the protrusion portions are configured by changing spring constants of the plate spring portions in an arrangement direction of the protrusion portions.

10. The sheet separation member according to claim 9, wherein the plate spring portions includes a plurality of plate springs disposed on the body portion at intervals in the arrangement direction of the protrusion portions, and wherein the separation loads of the protrusion portions are configured by changing spring constants of the plate springs in the arrangement direction of the protrusion portions.

11. The sheet separation member according to claim 9, wherein the plate spring portions include a plurality of plate springs disposed on the body portion at intervals in the arrangement direction of the protrusion portions, and wherein the separation loads of the protrusion portions are configured by changing arrangement density of the plate springs in the arrangement direction of the protrusion portions.

12. The sheet separation member according to claim 8, further comprising a fixation member formed in a box shape in which the body portion is received so that the fixation member supports the plate spring portions at end surfaces of opposite side walls thereof so as to fix the body portion to the sheet supply device while displaceably supporting the body portion, wherein the separation loads of the protrusion portions are configured by changing a height of each of the side walls of the fixation member along the arrangement direction of the protrusion portions.

13. A sheet separation member for use in a sheet supply device including a sheet feed roller that feeds stacked sheets, the sheet separation member comprising:

a body portion including a plurality of protrusion portions integrally formed with the body portion, the plurality of protrusion portions configured to engage with leading edges of the stacked sheets in a sheet feeding direction, and a plurality of arm portions that support the protrusion portions in positions where the protrusion portions are engaged with the leading edges of the sheets; and a plurality of plate spring portions integrally formed with the body portion to support the body portion in a predetermined region of the sheet supply device, wherein the protrusion portions are arranged to be spaced apart with one another at the body portion in a sheet stacking direction, and wherein the plate spring portions are arranged to be spaced apart with one another at the body portion in a direction of the arrangement of the protrusion portions except at at least one of upper side and lower side with respect to the sheet stacking direction.

14. A sheet separation member for use in a sheet supply device including a sheet feed roller that feeds stacked sheets, the sheet separation member comprising:

a body portion including a plurality of protrusion portions that engages with leading edges of the stacked sheets in a sheet feeding direction, and a plurality of arm portions that support the protrusion portions in positions where the protrusion portions are engaged with the leading edges of the sheets; and a plurality of plate spring portions integrally formed with the body portion to support the body portion in a predetermined region of the sheet supply device, wherein the protrusion portions are arranged to be spaced apart with one another at the body portion in a sheet stacking direction, wherein the plate spring portions are arranged to be spaced apart with one another at the body portion in a direction of the arrangement of the protrusion portions, and wherein the plate spring portions that are arranged at at least one of upper side and lower side with respect to the sheet stacking direction are formed to be narrower in width than the plate spring portions that are arranged at a central portion with respect to the sheet stacking direction.

15. A sheet supply device comprising:

a sheet storage portion that stores sheets;

a sheet feed roller that feeds the sheets stored in the sheet storage portion to a predetermined conveyance path;

an inclined surface located in the predetermined conveyance path so as to be inclined at an obtuse angle with respect to the sheets stored in the sheet storage portion, the inclined surface including a long hole being formed thereon so as to extend in a sheet conveyance direction; and a sheet separation member including:

a body portion including a plurality of protrusion portions integrally formed with the body portion, the plurality of protrusion portions configured to engage with leading edges of the stacked sheets in a sheet feeding direction, and a plurality of arm portions that support the protrusion portions in positions where the protrusion portions are engaged with the leading edges of the sheets, the plurality of protrusion portions being movable with respect to each other; and a plurality of plate spring portions integrally formed with the body portion to support the body portion in a predetermined region of the sheet supply device, wherein the sheet separation member is mounted in the sheet supply device so that the protrusion portions protrudes from the inclined surface through the long hole.

16. The sheet supply device as claimed in claim 15, wherein the sheet feed roller contacts a topmost one of the sheets by an urging force received from a support member having one end pivoted and the other end attached to the sheet feed roller.

17. The sheet supply device as claimed in claim 15, wherein the inclined surface is located downstream of the sheet feed roller with respect to a feeding direction of the sheets.

18. The sheet supply device as claimed in claim 17, wherein the sheet separation member is disposed at a position downstream in a feeding direction of the sheets of a position where the sheet feed roller contacts the topmost sheet.

19. The sheet supply device as claimed in claim 15, wherein the protrusion portions protrude from the inclined surface in an amount in a range of from about 0.1 mm to about 0.4 mm.

20. The sheet supply device as claimed in claim 15, wherein the protrusion portions protrude obliquely from the inclined surface at an obtuse angle with respect to the sheet conveyance direction.

21. The sheet separation member according to claim 1, wherein each of the plate spring portions has a common spring constant.

22. The sheet separation member according to claim 1, wherein a first group of the plate spring portions has a first spring constant and a second group of the plate spring portions has a second spring constant, where the first spring constant is different from the second spring constant.

23. A sheet separation member for use in a sheet supply device including a sheet feed roller that feeds stacked sheets, the sheet separation member comprising:

a body portion including a plurality of protrusion portions integrally formed with the body portion, the plurality of protrusion portions configured to engage with leading edges of the stacked sheets in a sheet feeding direction, and a plurality of arm portion pairs that support the protrusion portions in positions where the protrusion portions are engaged with the leading edges of the sheets; and a plurality of plate spring portion pairs integrally formed with the body portion to support the body portion in a predetermined region of the sheet supply device.

24. A sheet separation member comprising:

a body portion including a plurality of protrusion portions integrally formed with the body portion, the plurality of protrusion portions configured to engage with leading edges of stacked sheets in a sheet feeding direction, and a plurality of arm portions that support the protrusion portions in positions where the protrusion portions are engaged with the leading edges of the stacked sheets, the plurality of protrusion portions being movable with respect to each other; and a plurality of plate spring portions integrally formed with the body portion to support the body portion.

* * * * *